US007476829B2

(12) United States Patent
Kingman

(10) Patent No.: US 7,476,829 B2
(45) Date of Patent: Jan. 13, 2009

(54) PRE TREATMENT OF MULTI-PHASE MATERIALS USING HIGH FIELD STRENGTH ELECTROMAGNETIC WAVES

(75) Inventor: Samuel William Kingman, Nottingham (GB)

(73) Assignee: The University of Nottingham, Nottingham (GB)

( * ) Notice: Subject to any disclaimer, the term of this patent is extended or adjusted under 35 U.S.C. 154(b) by 0 days.

(21) Appl. No.: 10/509,988

(22) PCT Filed: Apr. 1, 2003

(86) PCT No.: PCT/GB03/01414

§ 371 (c)(1),
(2), (4) Date: May 9, 2005

(87) PCT Pub. No.: WO03/083146

PCT Pub. Date: Oct. 9, 2003

(65) Prior Publication Data

US 2005/0236403 A1 Oct. 27, 2005

(30) Foreign Application Priority Data

Apr. 2, 2002 (GB) ..... 0207530.7

(51) Int. Cl.
*H05B 6/70* (2006.01)
*H05B 6/64* (2006.01)

(52) U.S. Cl. ..... 219/695; 219/678

(58) Field of Classification Search ..... 219/695, 219/690, 696, 697, 746, 679, 678; 299/10, 299/14; 117/208, 206, 207

See application file for complete search history.

(56) References Cited

U.S. PATENT DOCUMENTS 4,778,970 A * 10/1988 Klaila ..... 219/697
5,003,144 A 3/1991 Lindroth et al. ..... 219/679
5,230,865 A * 7/1993 Hargett et al. ..... 422/102
5,369,034 A * 11/1994 Hargett et al. ..... 436/155
5,824,133 A * 10/1998 Tranquilla ..... 75/10.13

(Continued)

FOREIGN PATENT DOCUMENTS

EP 0041841 12/1981

(Continued)

OTHER PUBLICATIONS

Kingman et al. (2000) "The effect of microwave radiation on the magnetic properties of minerals," Journal of Microwave and Electromagnetic Energy, 35(3):144-150.

(Continued)

*Primary Examiner*—Daniel L Robinson
(74) *Attorney, Agent, or Firm*—Baker Botts LLP

(57) ABSTRACT

A method of microwave pre treatment of a multi-phase material (200) prior to a subsequent operation on the material (200). The material (200) having a first phase of material and a second phase of material. The method comprises heating the material electromagnetically, preferably with microwaves (202), to produce a power density of at least $10^9$ $Wm^{-3}$ in a continuous process in which the material (200) moves into and through an electromagnetic, preferably microwave, treatment area (212). The material (200) experiences exposure to microwaves (202), in the treatment area (212) for a time of the order of ½ second or less before the material (200) is passed out of the treatment area (212) for subsequent operation.

7 Claims, 29 Drawing Sheets

U.S. PATENT DOCUMENTS

| | | | | |
|---|---|---|---|---|
| 5,824,153 | A | 10/1998 | Suda et al. | 117/208 |
| 5,883,349 | A * | 3/1999 | Kingston | 204/157.15 |
| 6,011,248 | A * | 1/2000 | Dennis | 219/700 |
| 6,054,700 | A * | 4/2000 | Rokhvarger et al. | 219/759 |
| 6,888,116 | B2 * | 5/2005 | Dalton | 219/745 |
| 6,891,138 | B2 * | 5/2005 | Dalton | 219/634 |

FOREIGN PATENT DOCUMENTS

| | | |
|---|---|---|
| SU | 1326334 | 7/1987 |
| WO | 9218249 | 10/1992 |
| WO | 9734019 | 9/1997 |

OTHER PUBLICATIONS

Kingman et al. (2000) "The Influence of Mineralogy on Microwave Assisted Grinding. Minerals Engineering," 13(3): 313-327.

Bearman R. A. (1999) "The use of the point load test for the rapid estimation of Mode I fracture toughness," International Journal of Rock mechanics and Miming Sciences, 36: 257-263.

Kingman et al. (1999) "Effects of Microwave Radiation upon the Mineralogy and Magnetic Processing of a Massive Norwegian Ilmenite Ore," Magnetic and Electrical Separation, 9: 131-148.

Kingman et al. (1998) "Microwave Treatment of Minerals-A Review," Minerals Engineering, 11: 1081-1087.

Bearman et al. (1997 "The application of rock mechanics parameters to the prediction of comminution behaviour," Minerals Engineering 10(3): 255-264.

Kingman et al. (1997) "Applications of Microwave Radiation to Enhance Performance of Mineral Separation Processes," Innovates in Physical Separation of Minerals.

Salsman et al. (1996) "Short-Pulse Microwave Treatment of Disseminated Sulfide Ores," Minerals Engineering, 9(1): 43-54.

Fitzgibbon et al. (1990) "Thermally Assisted Liberation of Minerals-A Review," Minerals Engineering, 3(1/2):181-185.

Chen et al. (1984) "The Relative Transparency of Minerals to Microwave Radiation," Can. Metall. Quart., 23(1): 349-351.

Bieniawski Z. T. (1975) "The Point-Load Test in Geotechnical Practice," Engineering Geology, 9: 1-11.

Broch et al. (1972) "The Point-Load Strength Test," International Journal of Rock Mechanics and Mining Sciences , 9: 669-697.

Walkiwicz et al. (1988) "Microwave Heating Characteristics of Selected Minerals and Compounds," Minerals and Metallurgical Processing 5(1): 39-42.

* cited by examiner

Fig. 1A
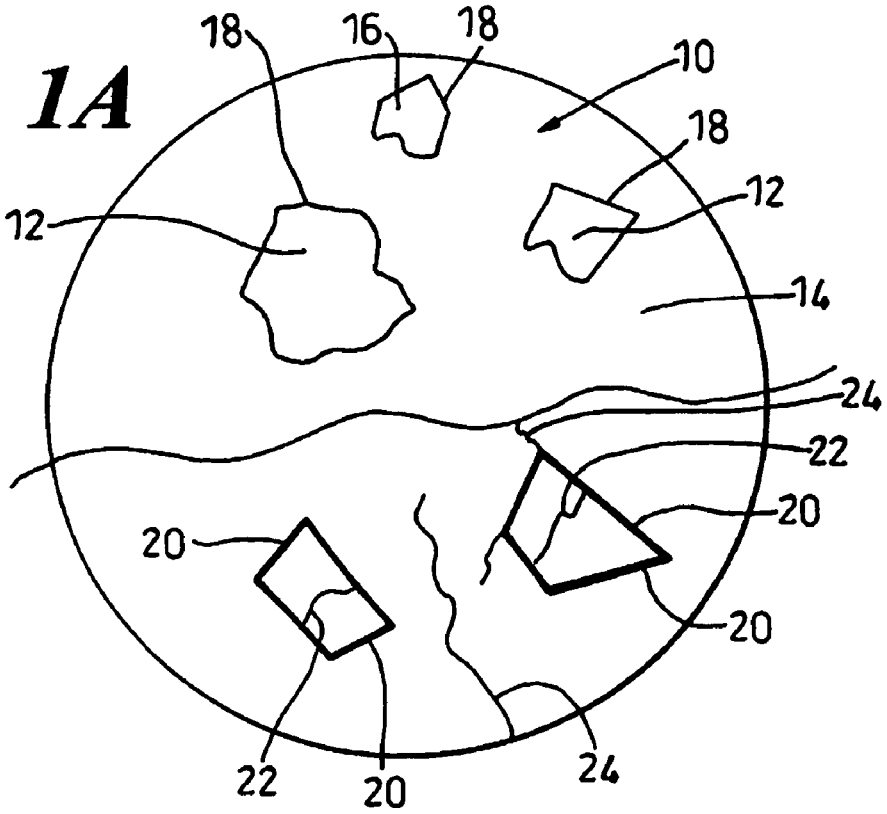
Fig. 1B
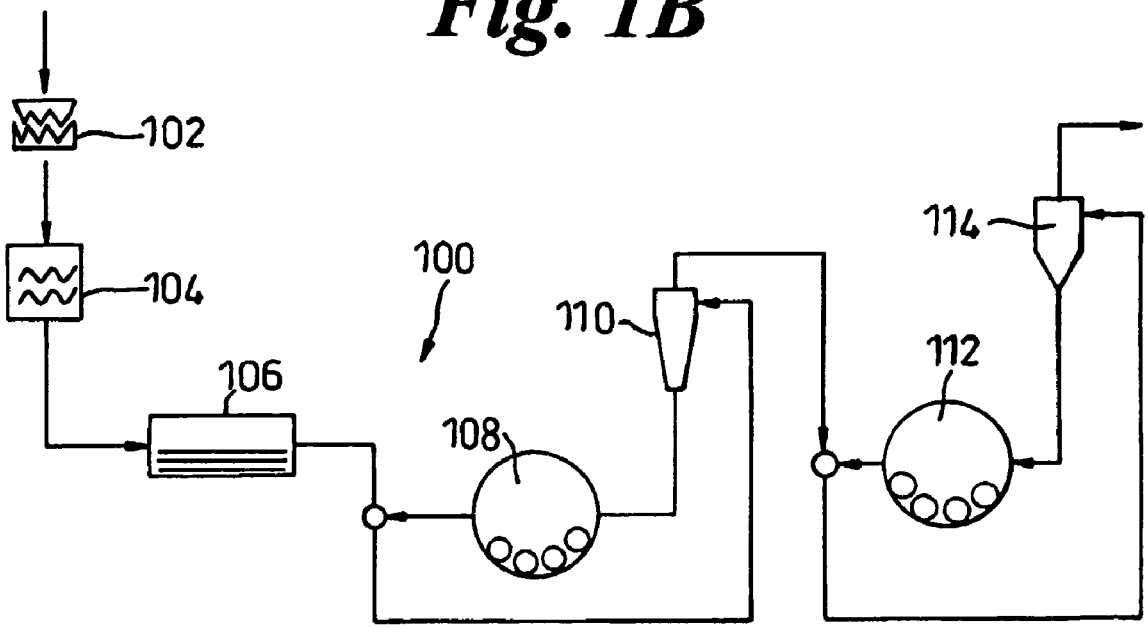
Fig. 2A

Model of the Calcite and Pyrite Ore Sample

Variation of dielectric loss factor of pyrite as function of temperature

Variation of microwave power density of pyrite in a 2.6kW 2.45 GHz Cavity as a function of temperature Direction of Simulated Loading During the Modelling of the Uniaxial Compression Test Affect of Microwave Heating time on the Predicted Unconfined Compressive Strength of the Theoretical Calcite and Pyrite Sample (2.6kW 2.45 GHz cavity, power density between $3x10^9 W/m^3$ and $9x10^9 W/m^3$)

Modelled Temperature Distributions for a 2.45 GHz 2.6 kW Microwave Cavity (power density between $3x10^9 W/m^3$ and $9x10^9 W/m^3$) having a heating interval of 1 second Modelled Temperature Distributions for a 2.45 GHz 2.6 kW Microwave Cavity (power density between $3x10^9 W/m^3$ and $9x10^9 W/m^3$) having a heating interval of 5 seconds Modelled Temperature Distributions for a 2.45 GHz 2.6 kW Microwave Cavity (power density between $3\times10^9$W/m$^3$ and $9\times10^9$W/m$^3$) having a heating interval of 15 seconds Modelled Temperature Distributions for a 2.45 GHz 2.6 kW Microwave Cavity (power density between $3\times10^9$ W/m$^3$ and $9\times10^9$ W/m$^3$) having a heating interval of 30 seconds

Affect of Varying Heating Times on the Numerically Modelled Stress-Strain Curves for the Theoretical Calcite and Pyrite Sample (Heated in a 2.6kW 2.45 GHz Microwave Cavity, power density between $3x10^9 W/m^3$ and $9x10^9 W/m^3$)

Shear Plane Development During Unconfined Compressive Tests for a 2.45 GHz 2.6 kW e Cavity PD between $3x10^9 W/m^3$ and $9x10^9 W/m^3$) having a heating interval of 1 second Shear Plane Development During Unconfined Compressive Tests for a 2.45 GHz 2.6 kW e Cavity PD between $3\times10^{9}$ W/m$^{3}$ and $9\times10^{9}$ W/m$^{3}$) having a heating interval of 5 second Shear Plane Development During Unconfined Compressive Tests for a 2.45 GHz 2.6 kW e Cavity PD between $3 \times 10^9 W/m^3$ and $9 \times 10^9 W/m^3$) having a heating interval of 15 second Shear Plane Development During Unconfined Compressive Tests for a 2.45 GHz 2.6 kW e Cavity PD between $3\times10^9$ W/m$^3$ and $9\times10^9$ W/m$^3$) having a heating interval of 30 second Modelled Temperature Distributions for a Microwave Cavity with a Power Density of $1 \times 10^{11}$ watts/$m^3$ having a heating interval of 0.05 seconds Modelled Temperature Distributions for a Microwave Cavity with a Power Density of $1 \times 10^{11}$ watts/$m^3$ having a heating interval of 0.25 seconds Modelled Temperature Distributions for a Microwave Cavity with a Power Density of $1 \times 10^{11}$ watts/$m^3$ having a heating interval of 0.5 seconds Modelled Temperature Distributions for a Microwave Cavity with a Power Density of $1 \times 10^{11}$ watts/$m^3$ having a heating interval of 1 second

Affect of Varying Heating Times on the Numerically Modelled Stress-Strain Curves for the Theoretical Calcite and Pyrite Sample (Heated Microwave Cavity with a Power Density of $1x10^{11}$ watts/$m^3$)

Affect of Microwave Heating Time on the Unconfined Compressive Strength of the Theoretical Calcite and Pyrite Sample (power density $1x10^{11}$ watt/m$^3$)

Microwave Heating Time (Power Density = $1x10^{11}$watt/m$^3$) vs Point Load Index Modelled Shear Plane Development During Unconfined Compressive Tests for a Microwave Cavity with a Power Density of $1 \times 10^{11}$ watts/$m^3$ having a heating interval of 0.05 seconds Modelled Shear Plane Development During Unconfined Compressive Tests for a Microwave Cavity with a Power Density of $1 \times 10^{11}$ watts/$m^3$ having a heating interval of 0.25 seconds Modelled Shear Plane Development During Unconfined Compressive Tests for a Microwave Cavity with a Power Density of $1 \times 10^{11}$ watts/$m^3$ having a heating interval of 0.5 seconds Modelled Shear Plane Development During Unconfined Compressive Tests for a Microwave Cavity with a Power Density of $1 \times 10^{11}$ watts/$m^3$ having a heating interval of 1 second Microwave Heating Time (2.6kW 2.45 GHz power density between $3x10^9 W/m^3$ and $9x10^9 W/m^3$) vs Point Load Index Plot of ECS vs t10 for Non-Treated and Microwaved Samples

| Mineral | Specific heat capacity (J/Kg°K) | | |
|---|---|---|---|
| | 298°K | 500°K | 1000°K |
| Calcite | 819 | 1051 | 1238 |
| Pyrite | 517 | 600 | 684 |

Table 1 Specific Heat Capacity as a Function of Temperature

| Mineral | Thermal conductivity (W/m°K) | | |
|---|---|---|---|
| | 273°K | 373°K | 500°K |
| Calcite | 4.02 | 3.01 | 2.55 |
| Pyrite | 37.90 | 20.50 | 17.00 |

Table 2 Thermal Conductivity as a Function of Temperature

| Mineral | Thermal expansion coefficient (1/°K) | | | |
|---|---|---|---|---|
| | 373°K | 473°K | 673°K | 873°K |
| Calcite | $13.1\times10^{-6}$ | $15.8\times10^{-6}$ | $20.1\times10^{-6}$ | $24.0\times10^{-6}$ |
| Pyrite | $27.3\times10^{-6}$ | $29.3\times10^{-6}$ | $33.9\times10^{-6}$ | — |

Table 3 Thermal Expansion Coefficient as a Function of Temperature

| Mineral | density Kg/m³ | Young's Modulus Gpa | Poisson's Ratio | Peak Strength | | | Residual Strength (after 1% strain) | | |
|---|---|---|---|---|---|---|---|---|---|
| | | | | $\phi°$ | cMPa | TMPa | $\phi_r$ ° | $c_r$MPa | $T_r$Mpa |
| Pyrite | 5018 | 292 | 0.16 | 54 | 25 | 15 | 54 | 0.1 | 0 |
| Calcite | 2680 | 797 | 0.32 | 54 | 25 | 15 | 54 | 0.1 | 0 |

Table 4 Mechanical Properties of the Minerals

| Heating time (seconds) | Maximum temperature (°K) | Minimum temperature (°K) | Unconfined compressive strength (MPa) |
|---|---|---|---|
| 0 | 300 | 300 | 126 |
| 1 | 350 | 300 | 126 |
| 5 | 460 | 320 | 123 |
| 15 | 700 | 400 | 97 |
| 30 | 900 | 600 | 79 |

Table 5 Modelled Temperatures and Unconfined Compressive Strengths for Various Microwave Heating Times (2.6kW 2.45Ghz, Microwave Cavity power density between $3x10^9 W/m^3$ and $9x10^9 W/m^3$

| Heating time (seconds) | Maximum temperature (°K) | Minimum temperature (°K) | Unconfined compressive strength (MPa) |
|---|---|---|---|
| 0 | 300 | 300 | 126 |
| 0.05 | 1200 | 300 | 57 |
| 0.25 | 1700 | 300 | 29 |
| 0.5 | 1900 | 300 | 26 |
| 1 | 1900 | 300 | 25 |

Table 6 Modelled Temperatures and Unconfined Compressive Strengths for Various Microwave Heating Times (Microwave Cavity with a Power Density of $1x10^{11}$ watt/$m^3$).

| time(secs) | Is(50) | Kic | b | A.b | A |
|---|---|---|---|---|---|
| 0 | 5.25 | 1.097 | 1.91 | 107.61 | 56.03 |
| 10 | 4.45 | 0.93 | 2.54 | 145.16 | 57.14 |
| 30 | 3.4 | 0.7106 | 4.22 | 238.56 | 56.63 |

Table 7 Breakage Parameters for 2.6kW Multimode Cavity Microwave Treatment (power density between $3x10^9 W/m^3$ and $9x10^9 W/m^3$)

| time | Is(50) | Kic | b | A.b | A |
|---|---|---|---|---|---|
| 0 | 5.25 | 1.097 | 1.91 | 107.01 | 56.03 |
| 0.1 | 1.8 | 0.376 | 11.83 | 772.67 | 65.31 |
| 0.2 | 1.25 | 0.2615 | 21.96 | 1513.41 | 68.91 |

Table 8 Breakage Parameters for 15kW, 2.45GHz (Power density $1x10^{11}$ W/$m^3$ Single Mode Microwave Cavity Treated Ore

PRE TREATMENT OF MULTI-PHASE MATERIALS USING HIGH FIELD STRENGTH ELECTROMAGNETIC WAVES

This invention relates to the production of high electric field strength electromagnetic radiation, typically but not necessarily microwave radiation and typically but not necessarily for the weakening of multi-phase materials using microwaves.

The invention arises from a consideration of how to process mined ores and it is convenient to illustrate it in that context. It will be realised that the invention has wider applications.

It is known to process, e.g. by milling, ores to extract a wanted mineral from unwanted surrounding rocks or minerals, comminution of ores is a well-established industry. Milling or grinding ores is very energy intensive. It has been estimated that one and a half percent of all energy used in the United States is used in the comminution of ores and minerals. It is very big business.

There are many suggestions as to how to pre-treat materials before they are processed by a milling/grinding machine. Some involve chemical treatment, some involve heat treatment, and there are proposals, but as yet unsuccessfully implemented, to pre-treat with microwaves. There is also a proposal to use electric discharges. The prior art, both implemented and speculative, points in many, often contradictory, directions.

Some literature in the field includes: U.S. Pat. No. 5,824,133, PCT Patent Application WO 92/18249, British Patent Application No. GB 2 120 579, and the papers "The Influence of Minerology on Microwave Assisted Grinding", S. W. Kingdom, W. Vorster and N. A. Rowson, Mineral Engineering Vol. 13, No. 2, Elsevier Science Limited, 0892-6875(99)00010-8; "Effects of Microwave Radiation upon the Mineralogy and Magnetic Processing of a Massive Norwegian Ilmenite Ore" by S. W. Kingman, G. M. Corfield and N. A. Rowson, Magnetic and Electrical Separation, Vol. 9. published by Overseas Publishers Association N.V.; "The Effects of Microwave Radiation on the Processing of Palabora Copper Ore" by S. W. Kingman, W. Vorster and N. A. Rowson, published by The Journal of the South African Institute of Mining and Metallurgy, May/June 2000; "Microwave Treatment of Minerals—A Review", by S. W. Kingman and N. A. Rowson, published by Minerals Engineering, Vol 11, Elsevier Science Limited, 0892-6875(98)00094-6; "The Effect of Microwave Radiation on the Processing of Neves Corvo Copper Ore" by W. Vorster, N. A. Roswon and S. W. Kingman, International Journal of Mineral Processing 63(2001)29-44 published by Elsevier Science B.V.; "Short-Pulse Microwave Treatment of Disseminated Sulfide Ores" by J. B. Salsman, R. L. Williamson, W. K. Tolley and D. A. Rice, Minerals Engineering, Vol. 9, No. 1, 1996 published by Elsevier Science Limited 0892-6875(95)00130-1; "The Effect of Microwave Radiation on the Magnetic Properties of Minerals" by S. W. Kingman and N. A. Rowson, Journal of Microwave Power and Electromagnetic Energy Vol 35, No. 3, 2000; "Applications of Microwave Radiation to Enhance Performance of Mineral Separation Processes" by S. W. Kingman, N. A. Rowson and S. Blackburn, IMN 1997 ISBN-1870706388.

Many of these discuss having conventional multi-mode microwave producing machines applying microwaves for quite long periods (10 seconds or much longer) to batches of minerals, and then processing them by crushing and/or grinding.

It is reported in some of the above papers that the energy expended in microwaving minerals can be far more than the energy saved in the comminution process.

Some of the proposals have few experimental facts and are largely theory, and some have experimented not on a real ore but a ground mixture of two minerals to assess their thermal performance, but not the stress at the boundary between minerals. Some predict temperature rises that will melt or chemically alter the minerals concerned, making it difficult or impossible to separate the mineral economically and are therefore unappealing.

The above means that in practice a designer of a mineral processing plant does not consider microwave pre-treatment as being at all feasible/desirable. It is not currently seen as being a way to reduce overall costs. There is a prejudice in the art away from using microwaves. It is not known that there is even a single production-scale facility that uses pre-treatment by microwaves as a conditioning step in the treatment of ores prior to comminution.

The UK Patent Office has conducted a search and has found the following documents:

GB 2205559 (Wollongong Uniadvice Ltd.) discloses a method of drying and heating ores where heat is conducted using a carbon phase material.

EP 0041841 (Cato Research Corporation) discloses a process using microwave energy to chemically change a compound to aid extraction from the ore.

WO 97/34019 (EMR Microwave Technology Corporation) discloses a method for bringing about a metallurgical effect in a metal-containing ore.

WO 92/18249 (The Broken Hill Proprietory Company Ltd.) discloses a process for recovery of a valuable species in an ore which has a process time of up to 1 hour exposing the ore to pulses of microwave energy of 1 to 30 seconds duration with intervals of 10 seconds to 2 minutes between pulses.

U.S. Pat. No. 5,003,144 (Lindroth) discloses apparatus involving the use of microwave radiation for pre-weakening a mineral. Extended use of microwave radiation leads to substantial heating of the mineral, which can in turn lead to chemical changes occurring in the mineral, and degradation of the desired mineral.

According to a first aspect of the invention we provide a method of microwave pre treatment of a multi-phase material prior to a subsequent operation on the material, the material having a first phase of material and a second phase of material, the method comprising heating the material electromagnetically at a power density of at least $10^9$ $Wm^{-3}$ in a continuous process in which the material moves into and through an electromagnetic treatment area and experiences exposure to electromagnetic energy in the treatment area for a time of the order of ½ second or less, and passing the material out of the treatment area for said subsequent operation.

An important application of the invention is in mineral processing to weaken the bond between a first phase of material and a second phase of material in a multi-phase composite material. For example, ores or minerals that are desired to be extracted are found in a different phase of rock.

By using microwaves to heat two phases in a material (e.g. rock) differentially it is possible to have differential expansion over the two phases, and to cause cracks or weakening of their interface. This can facilitate the extraction of the mineral from the rock. There is preferably still post-microwave treatment of the ore to extract the desired material, for example mechanical pre-treatment of the ore or rock to separate the first and second phase materials.

We have also discovered a very interesting, commercially useful, effect. It is necessary to heat multi-phase materials (or other materials) with microwaves for far less time than is previously been thought desirable. We may expose the material to high intensity microwaves first for something of the order of a second or less, but in all probability of the order of ½ second or less, or the order of a quarter of second less, or the order of 0.1 of a second or less, or of the order of 0.01 second or less, or of the order of 0.001 second or less, or possibly even the order of 0.0001 second or less. Depending upon the choice of first and second phase materials, about 1 ms of exposure of a material in a microwave application zone (or less) may be desirable. For other applications exposure in a microwave zone to microwaves for a time of the order of 0.1, or 0.2, of a second may be the best weakening effect for power expenditure with a power density appropriately high. Typical power density that we would have in mind might be about $10^{12}$ watts per cubic meter or above, or better still $10^{15}$ or $10^{16}$ $Wm^{-3}$ or above.

It will be appreciated that material may be in a treatment zone/pass through it for a period of time that is longer, or much longer, than that for which the material is actually exposed to electromagnetic radiation.

We have also appreciated that it is possible to pass material through a microwave cavity in a continuous stream, for a continuous treatment process. The microwave cavity has high electric field which in turn produces high power densities (e.g. $10^{15}$ $Wm^{-3}$ or $10^{16}$ $Wm^{-3}$ or more) and material can be made to move through high field strength electromagnetic waves, residing in the high intensity region for only a short time. This has the double benefit of increasing the throughput of materials through the treatment machine, and using the knowledge that we do not need to apply microwaves to materials for very long to achieve the desired effect. The two advantages have synergistic effect.

In some embodiments the method comprises creating a standing wave of microwaves in a cavity and ensuring that the composite material is disposed in the cavity at a position on or about a maximum intensity of the standing wave.

The method may have a guide means which guides the composite material to the position of a maxima of the standing wave.

According to another aspect of the invention we provide a method of weakening the bond between a first phase of material and a second phase of material in a multi-phase composite material comprising applying a high powered density of microwave, or high electric field strength microwaves, to the composite material for an exposure time that is of the order of a ½ or ¼ of a second or less.

By order of ½ or ¼ of a second or less in the above definition we mean in some embodiments to exclude 1 second, and in others to still include about 1 second.

According to another aspect of the invention we provide apparatus for microwave treatment of material comprising:

a microwave treatment zone;

a microwave emitter disposed at said microwave treatment zone;

a material transporter adapted to transport material through the microwave treatment zone; the arrangement being such that:

the microwave emitter is adapted to emit microwaves at a power density of at least $10^9$ $Wm^{-3}$;

and the material transporter is adapted to transport said material through the microwave treatment zone fast enough so that said material experiences applied microwaves in said zone for a time of the order of ½ second or less.

According to another aspect of the invention we provide a method of microwave processing material comprising applying a high power density microwave, or high electric field strength microwave, to the material for an exposure time that is of the order of ½ or ¼ of a second or less.

According to another aspect of the invention we provide apparatus for processing a material comprising a microwave cavity adapted to apply high power density microwaves to the material for an exposure time that is of the order of ½ or ¼ of a second or less.

Preferably the exposure time is achieved by passing the material through a microwave cavity at a speed so as to achieve the desired exposure time.

According to another aspect of the invention we provide apparatus for weakening the bond strength between a first phase of material and a second phase of material in a multi-phase composite material comprising a microwave cavity adapted to apply high power density microwaves to the composite material for an exposure time that is of the order of ½ or ¼ second or less.

We may expose the ore to microwaves or other radiation for 1 second or so, or longer, after all, and protection for that is also sought.

According to another aspect of the invention we provide a method of continuous processing of ore or rocks comprising applying high electric field strength microwaves to create high power densities, on a continuous basis to ore or rocks passing through a microwave cavity or zone to weaken the ore or rocks, and subsequently passing the continuous flow of ore or rocks to a mechanical treatment machine and mechanically breaking up the ore or rocks.

The microwaves may be pulsed, and applying them on a continuous basis is not meant to exclude repeated pulses of microwaves.

A reduction in overall energy consumption—quite a serious reduction—may be available if we pre-treat the ore or rocks with microwaves so as to weaken them and then break them up in a mechanical comminution process.

Moreover, a continuous process has a higher throughput, and can cope with higher volumes than batch processes. This makes the process even more economically attractive.

It is particularly elegant that once we have a high enough electric field strength we can then flow material (whether that be for weakening the bond between different phases, or other purposes) through the microwave field in a continuous manner at a rate that is fast enough to expose the material to the high intensity microwave for only a short time, (e.g. ½ or ¼ second or less, perhaps of the order of 1 ms), and the fact that the material is exposed for a short time reduces the cost per unit of material, the fact that there is a continuous process improves the throughput, the fact that the materials have to flow quite fast through the microwave cavity/zone improves the throughput, and all of these things reduce the cost of the processing per unit of material process.

The electric field strength of the microwaves and the time of exposure necessary to cause weakening/differential heating are related; the higher the field strength the shorter need be the exposure time.

According to another aspect of the invention we provide apparatus for continuous processing of ore or rocks comprising means for applying high electric field strength microwaves to create high power densities, on a continuous basis to ore or rocks and feed means adapted to pass subsequently the continuous flow of ore or rocks to a mechanical treatment machine adapted mechanically to break up the ore or rocks.

We have appreciated that a higher temperature gradient is needed to separate ores and minerals from the surrounded unwanted material.

According to further aspects of the invention we provide a method of weakening the interface between a first phase of material and a second phase of material comprising creating a temperature gradient at an interface between the first and second phases of at least 100° C., possibly by using a standing wave of microwaves to heat the first and second phases differentially.

According to another aspect of the invention we provide apparatus for weakening the interface between, or separating, a first phase of material from a second phase material, the apparatus being capable of creating a temperature gradient at an interface between the first and second phases of at least 100° C., possibly by creating a standing wave of microwaves to heat the first and second phases differentially.

A single mode cavity may be provided to produce a standing wave.

According to another aspect of the invention we provide a method of rapidly heating a material comprising creating a standing wave of microwaves and a region of maximum electric field strength, and having material disposed in said region of maximum electric field strength.

We have realised that standard multi-mode microwave cavities, similar to those found in conventional kitchen microwave ovens, have many advantages, are very commonly available and are the equipment of choice for very many areas, but that they do not achieve maximum electric field strength. Multi-mode cavities do not have a single standing wave created in them—they deliberately "smear" their energy out uniformly across the cavity (or more or less uniformly) so as to achieve any effect evenly—or more evenly—throughout the volume of the cavity. This has been the drive of multi-mode cavity designers. However, we have appreciated that there can be times when processing a material when very high electric field strengths are required and that the best way to obtain these, in the absence of sufficiently powerful multi-mode cavity machines at a reasonable cost, is to use a microwave cavity which can sustain, and does sustain, a single standing wave. This single standing wave then has maximum and minimum electric field regions, which coincide with maximum and minimum power density (there is a relationship between power density and electric field strength and electric field strength varies with a power greater than 1 in comparison to power density—generally a squared power relationship). We have then appreciated that in order to apply the maximum electric field strength, produced by a typical microwave generator (or any particular specific microwave generator) it is desirable to align the position of the material to be processed with the position of the maxima in the standing wave. This can typically be achieved by controlling the position of the material relative to the cavity, but alternatively it is possible theoretically to move the position of the maxima to suit the position of the material within the cavity, by appropriately tuning the standing wave. Preferably a single mode microwave cavity is used. A single mode microwave cavity enables us to provide a good standing wave.

According to another aspect of the invention we provide a method of weakening the bond between a first phase of material and a second phase of material in a multi-phase composite material, the method comprising inducing a high thermal gradient at an interface between the first and second phases by applying microwaves to create a power density of at least $10^9$ watts per cubic meter, and creating a standing wave having an area of high electric field strength and positioning the material at or about the area of high electric field strength.

According to another aspect of the invention we provide a method of microwave pre-treatment of a multi-phase material prior to a subsequent operation on the material to extract one material from the other(s), the method comprising providing a continuous feed of the multi-phase material through a region in which microwave radiation is present at a speed to allow a throughput of multi-phase material of at least 500 tonnes per hour, the microwaves creating a power density of at least $10^9$, $10^{10}$, $10^{12}$, $10^{13}$, or $10^{14}$ $Wm^{-3}$, the material being present in the microwave radiation region for a time during which time it experiences a plurality of pulses of microwave energy such as to expose the material to microwaves for a summed duration exposure time of the order of a few ms, or 1 ms, or less, and wherein the overall bulk temperature of the multi-phase material does not rise by more than about 40° C., and wherein a thermal stress is created between phase boundaries which is strong enough to break bonds between the different phases, and wherein there are no significant changes to the chemical properties of the phase of materials to be extracted.

The microwaves may be applied in pulses of a duration of the order of a few μs, or tens or hundreds of μs, or less.

Embodiments of the invention will now be described by way of example only, with reference to the accompanying drawings, of which:

FIG. 1*a* schematically illustrates a two-phase rock having crystals of a first material embedded in a second material;

FIG. 1*b* shows schematically the rock of FIG. 1*a* after treatment by microwaves according to the present invention;

FIG. 2A shows schematically a mineral extraction plant and process in accordance with the present invention;

Figure 3A:
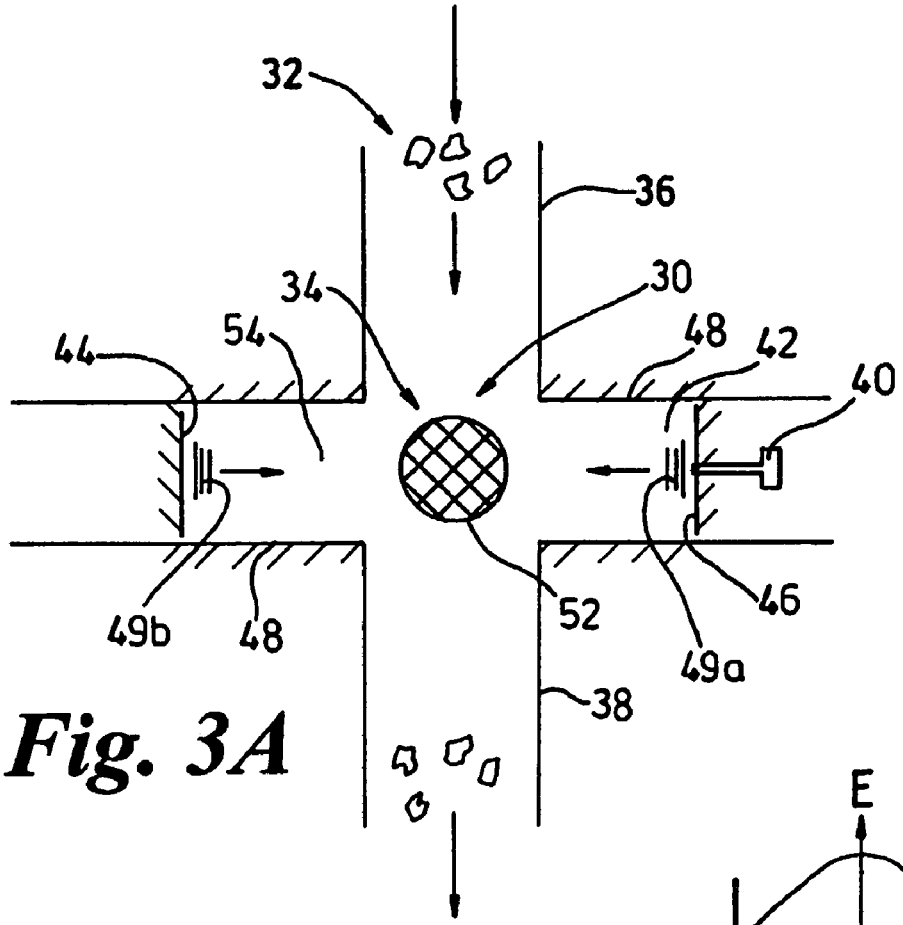
FIG. 3A shows schematically a microwave pre-treatment unit for use in the apparatus of FIG. 2.
Figure 5:
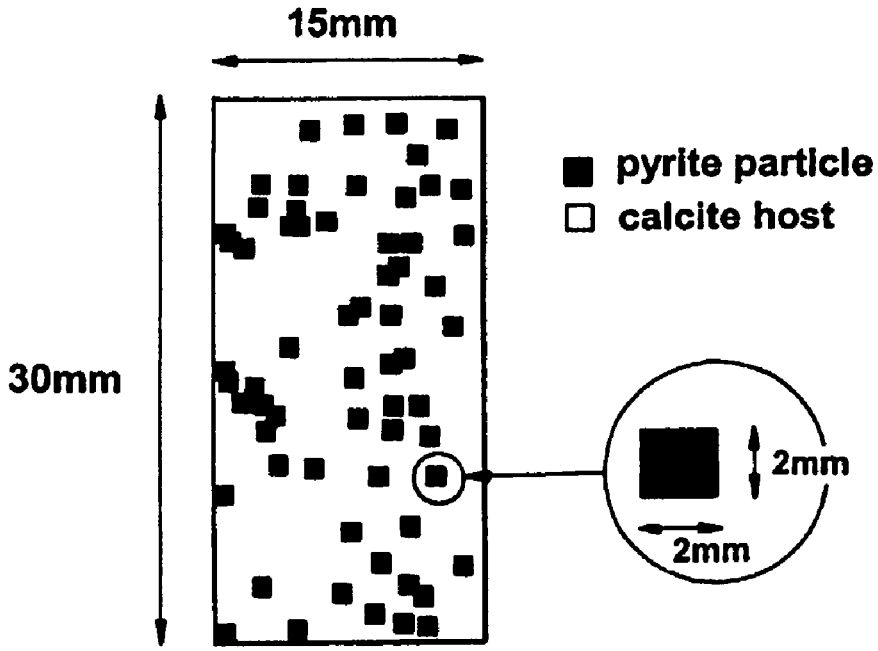
Figure 6:
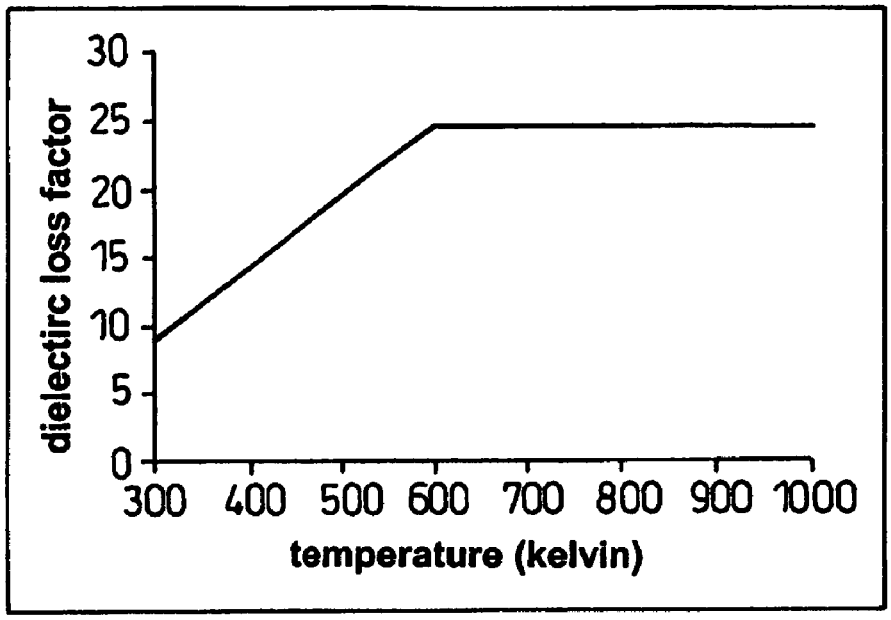
Figure 7:
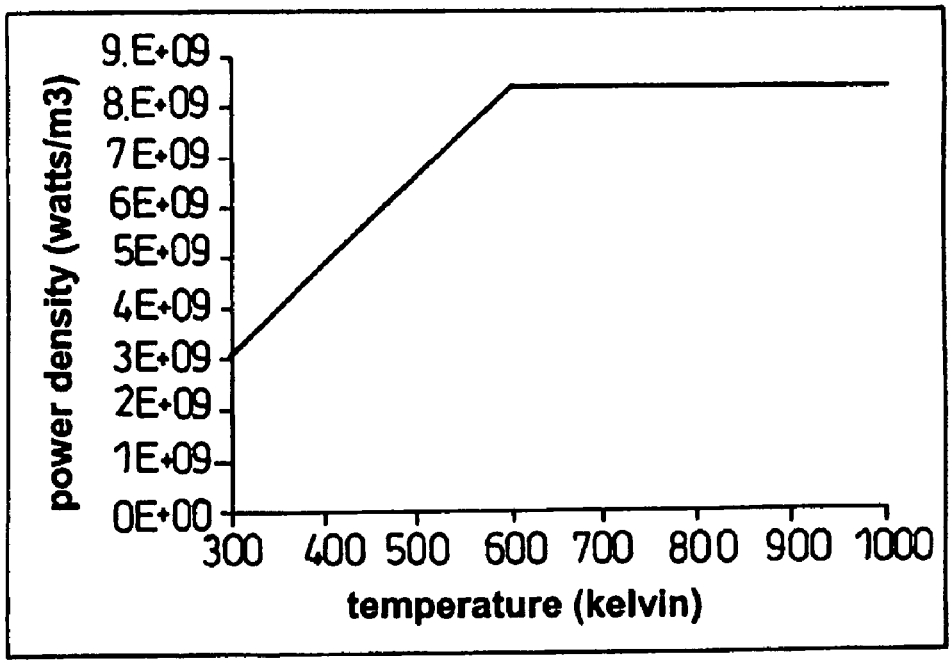
Figure 8:
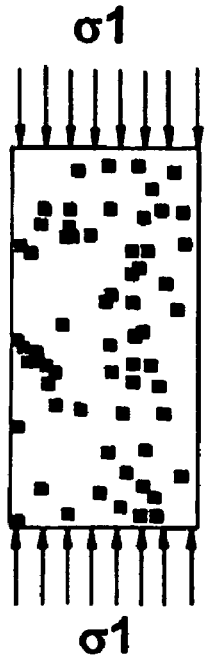
Figure 11:
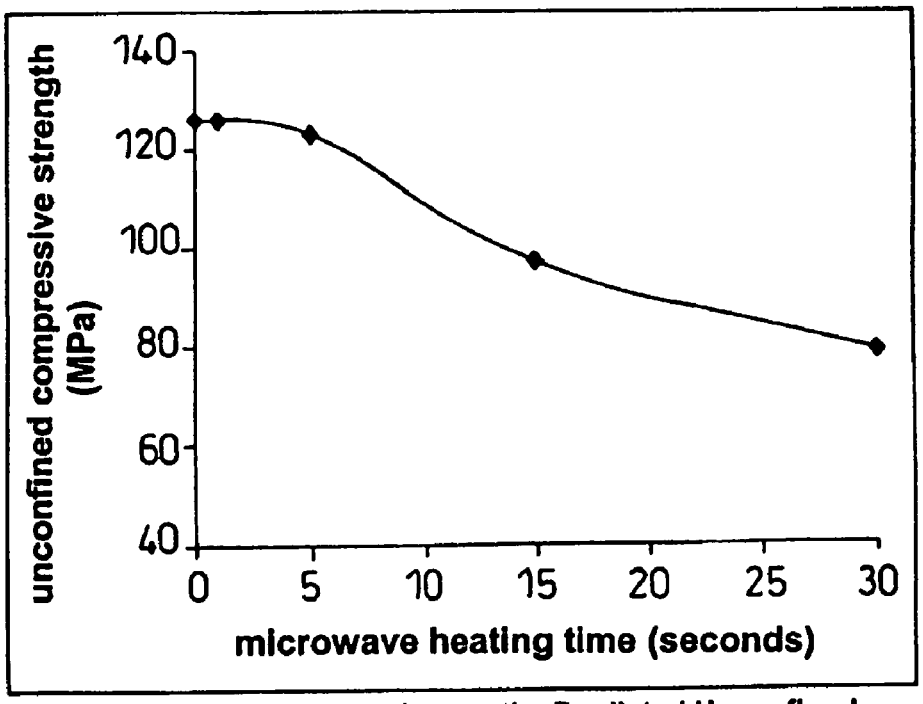
Figure 9A:
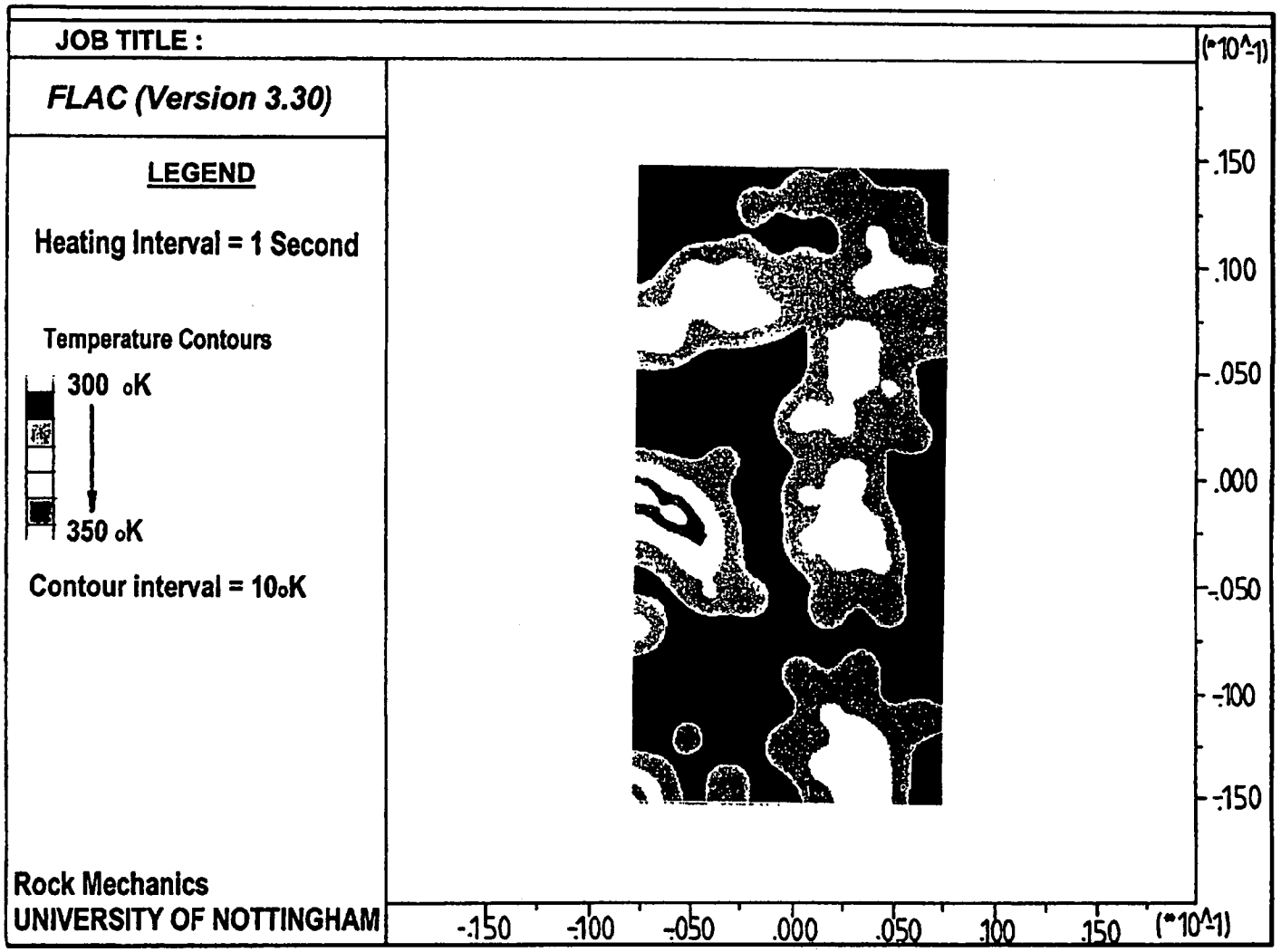
Figure 9B:
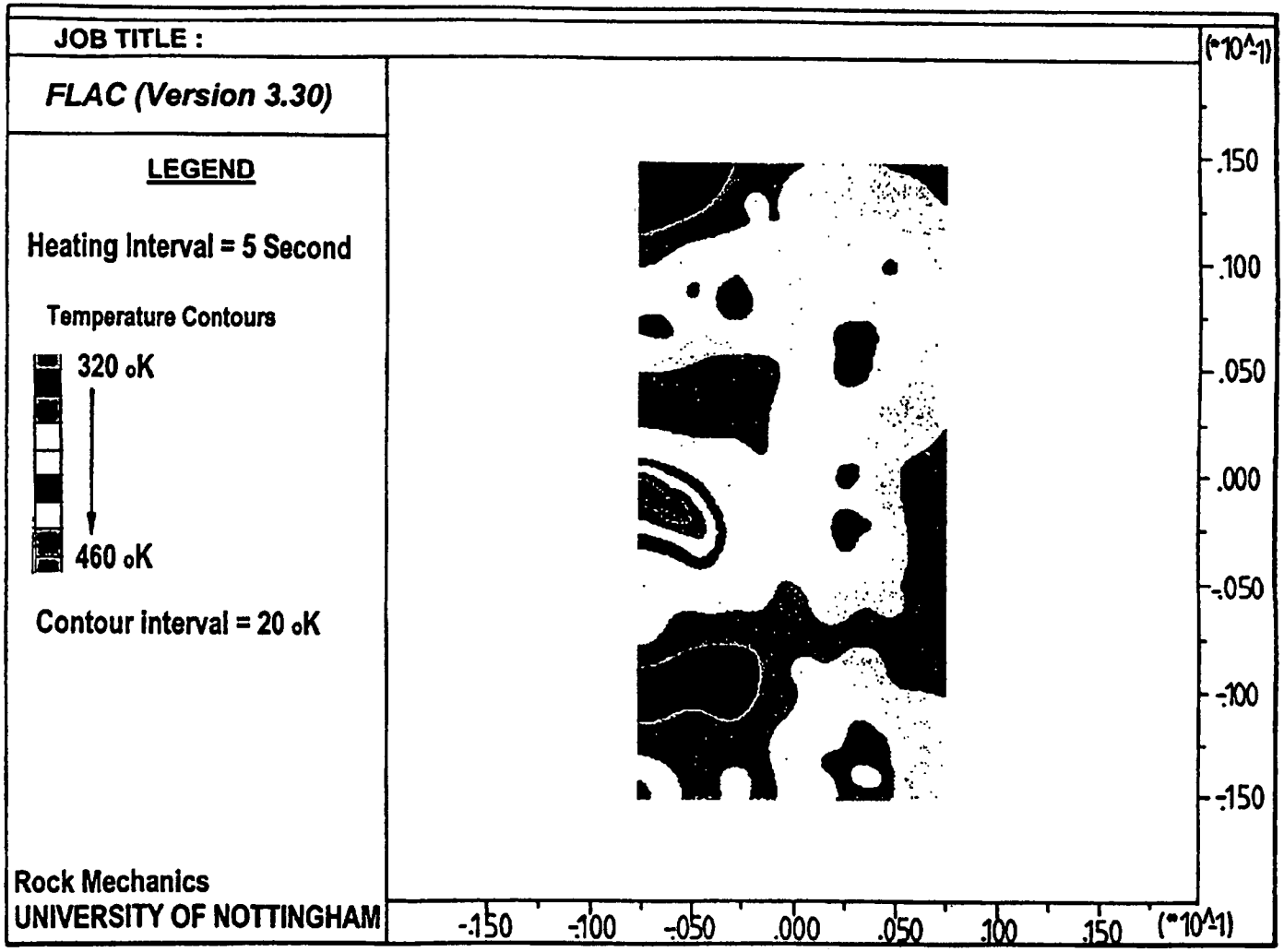
Figure 9C:
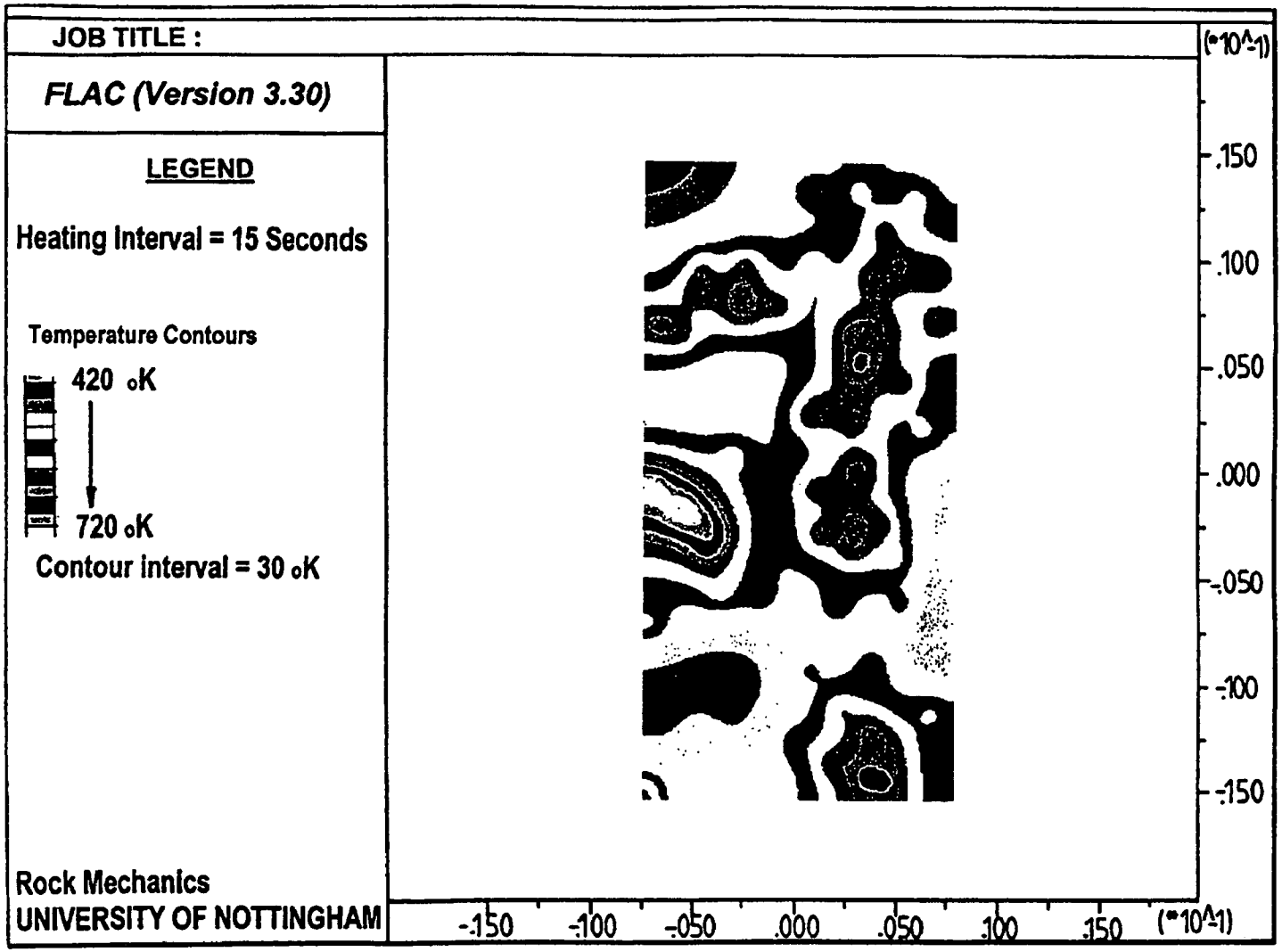
Figure 9D:
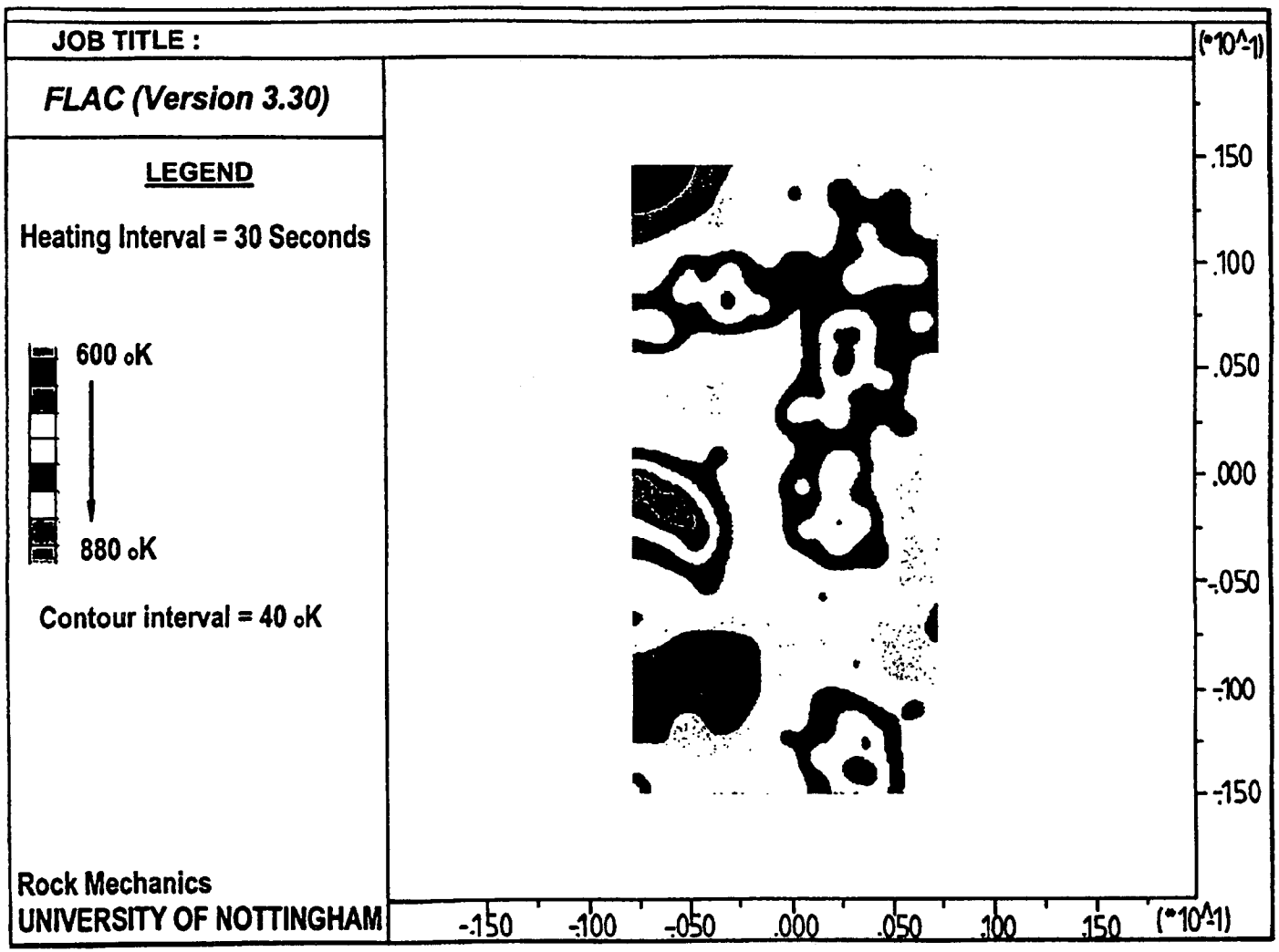
Figure 10:
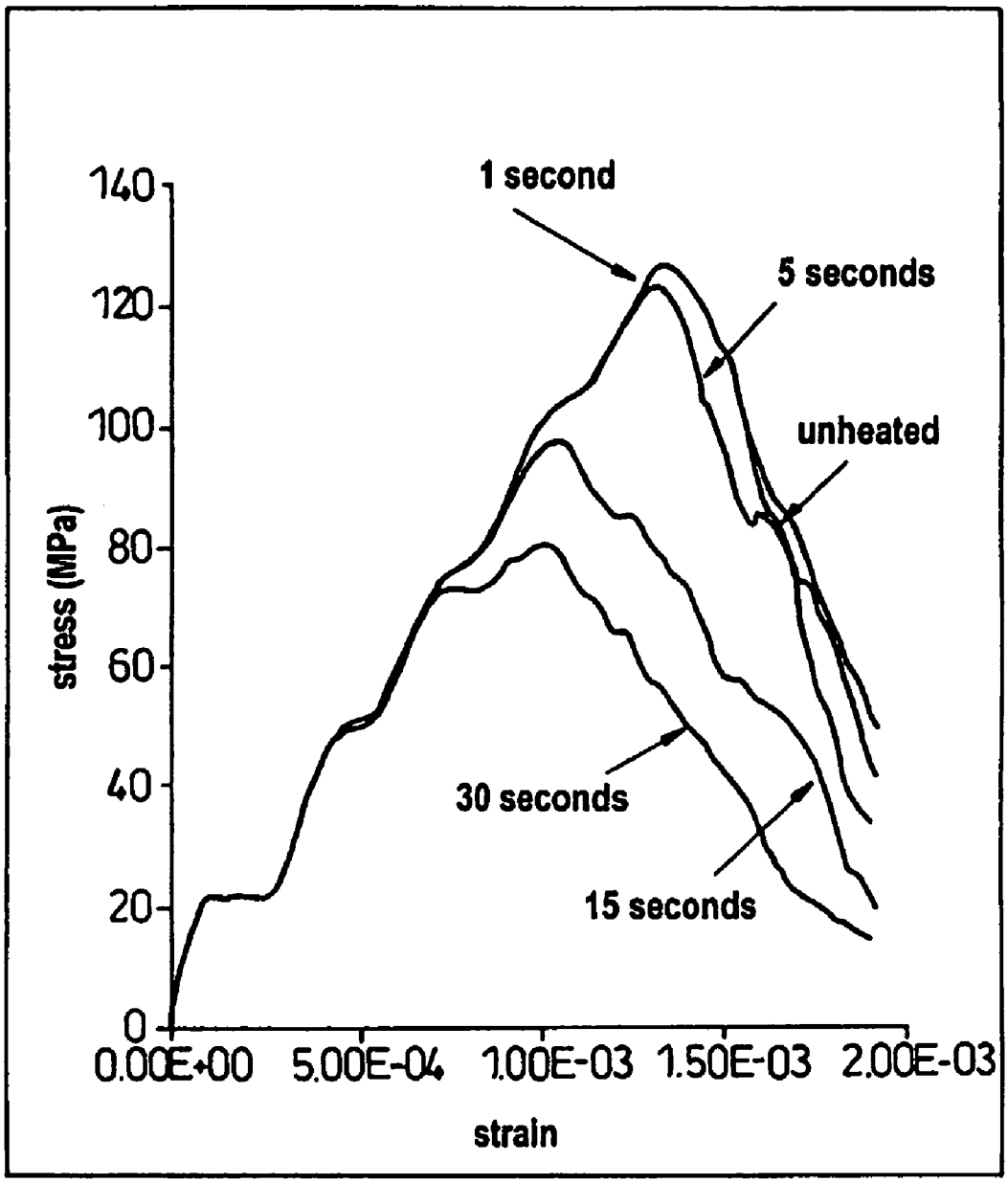
Figure 12A:
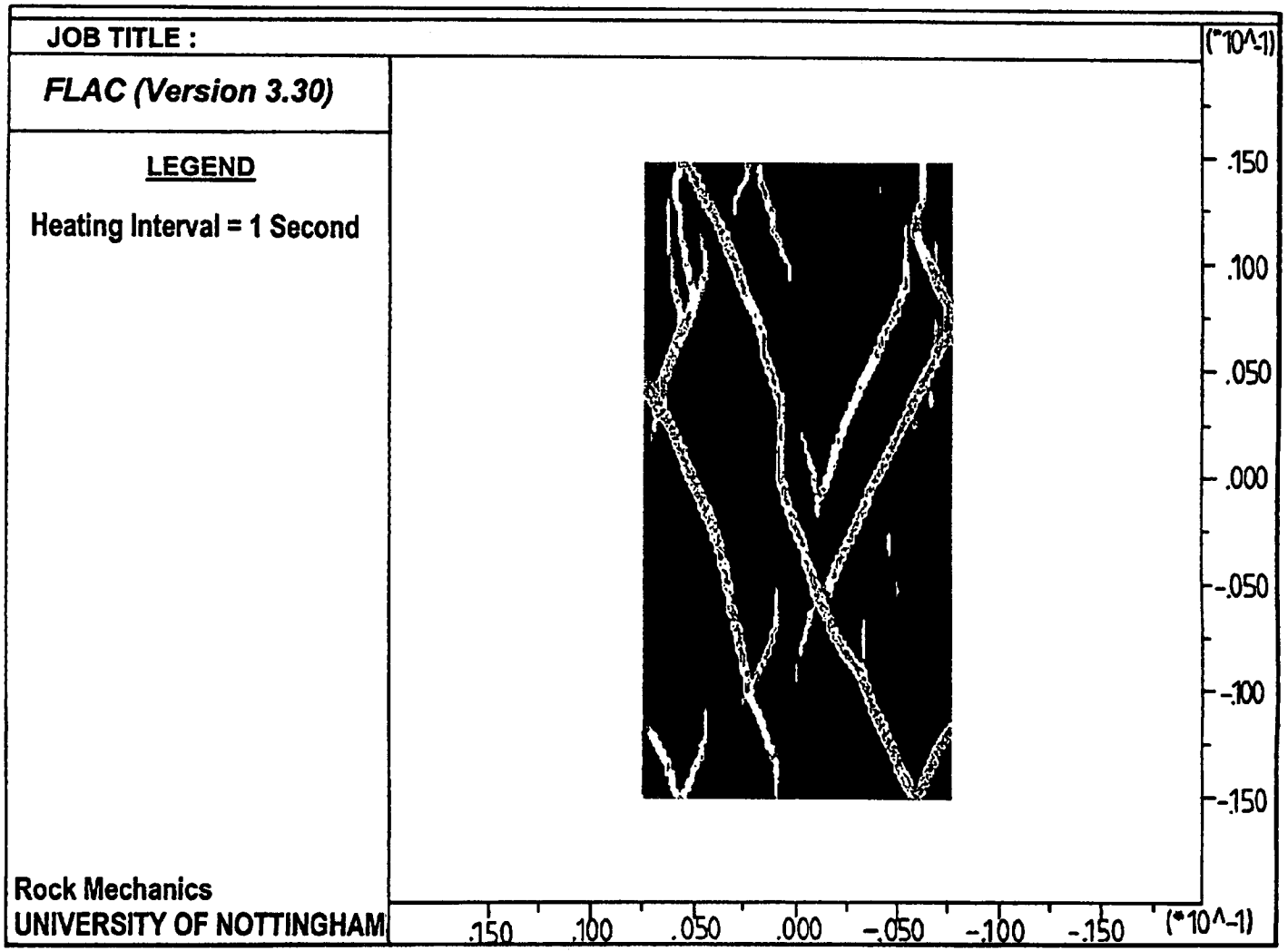
Figure 12B:
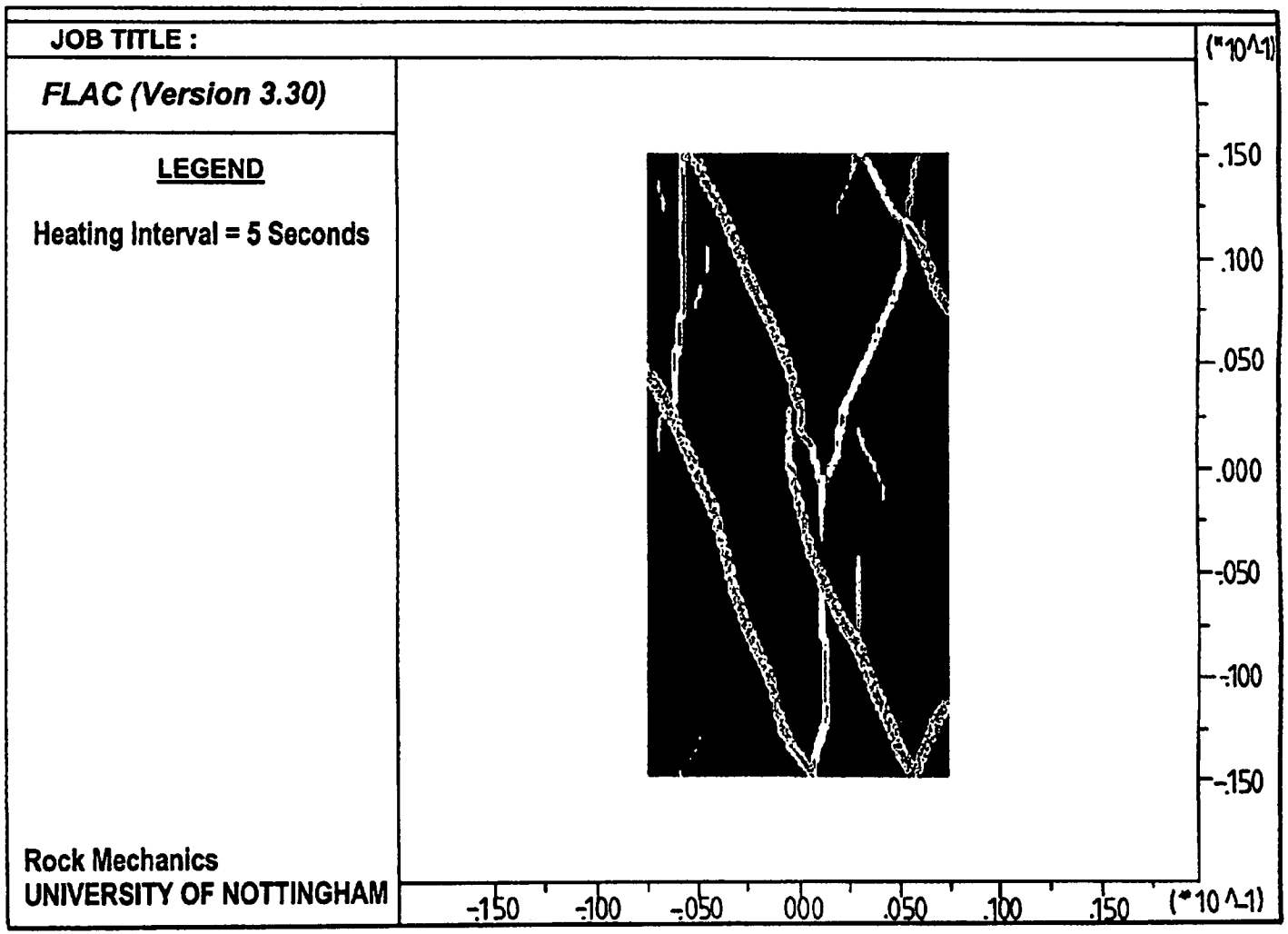
Figure 12C:
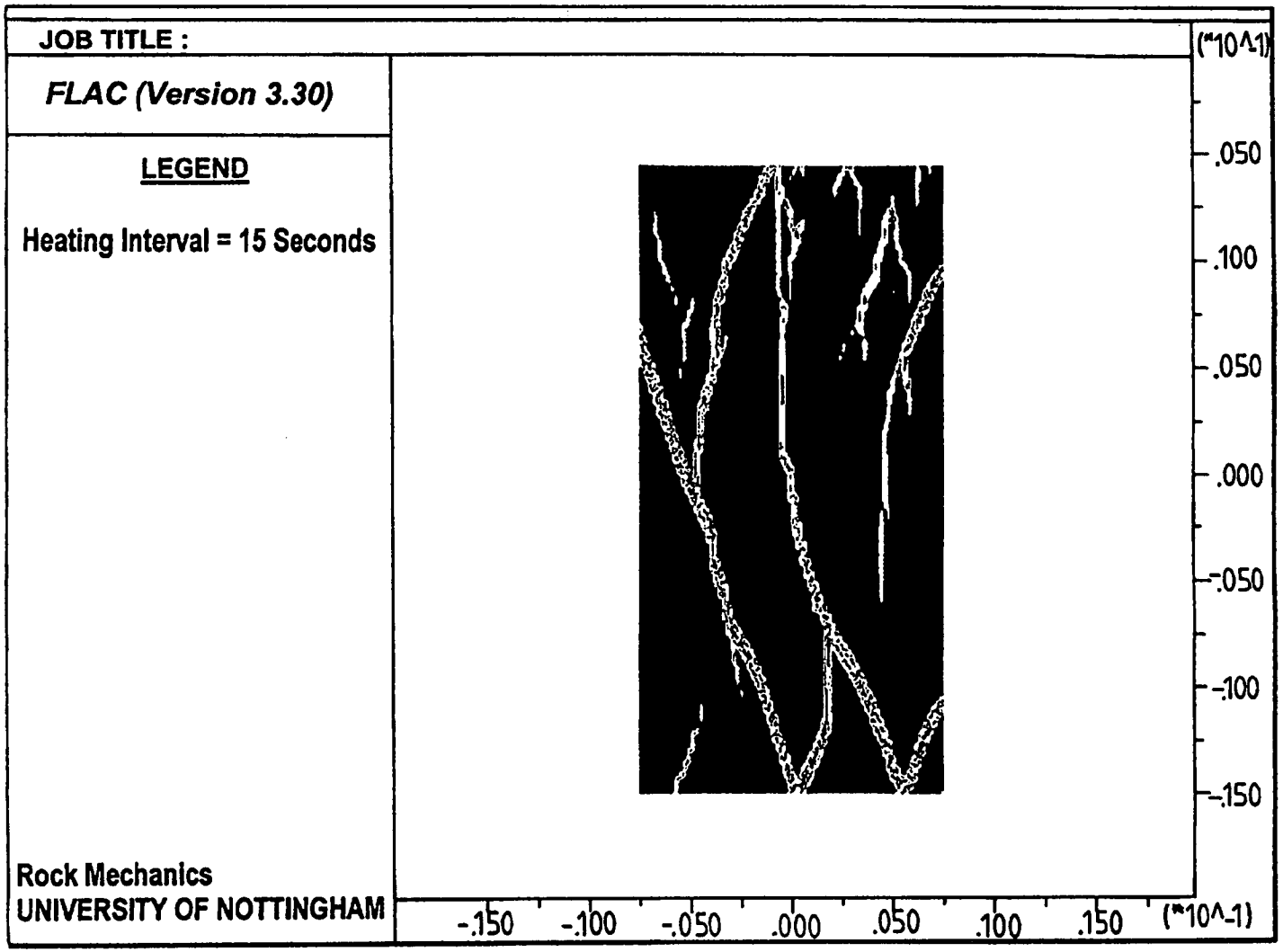
Figure 12D:
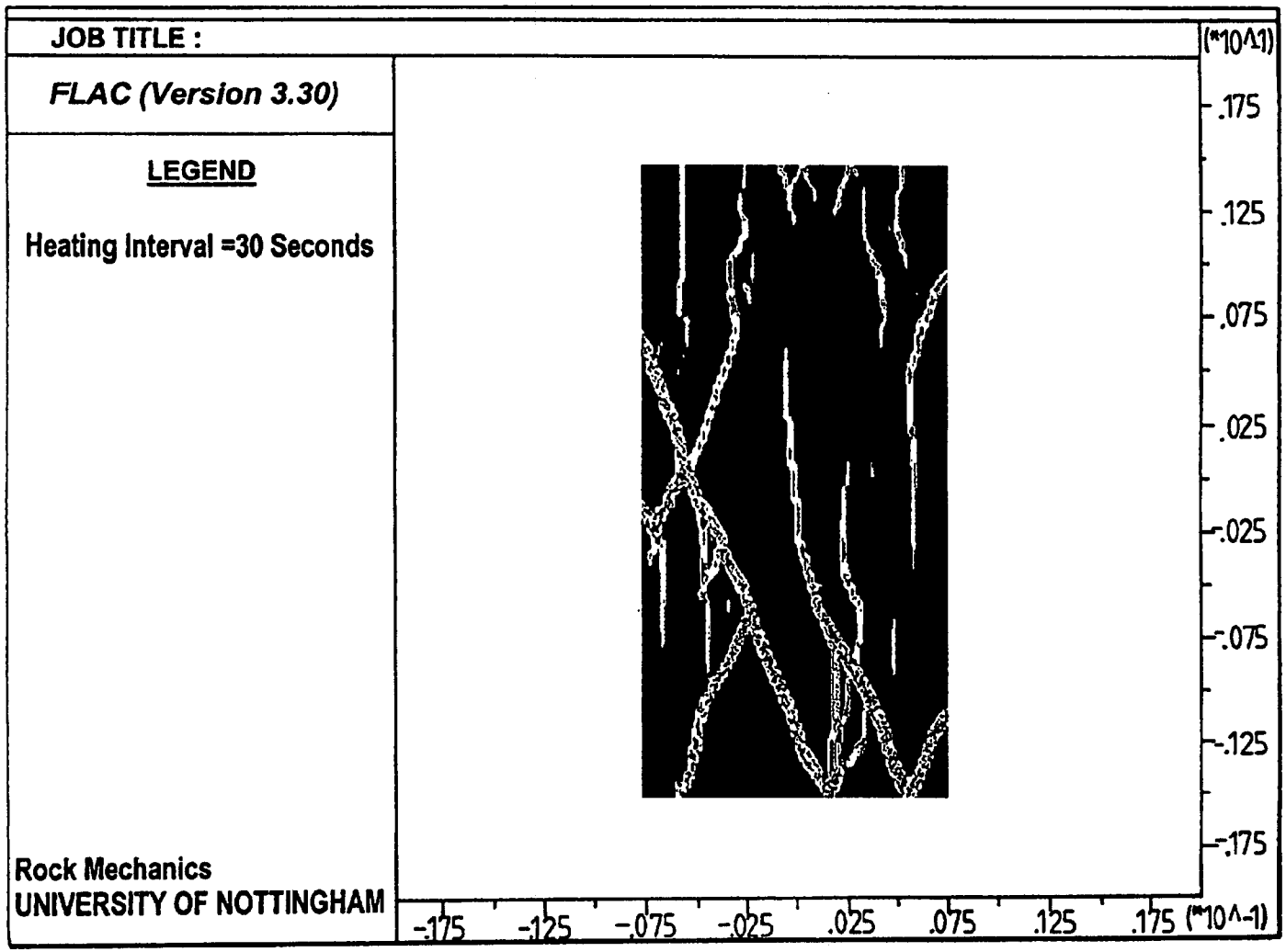
Figure 13A:
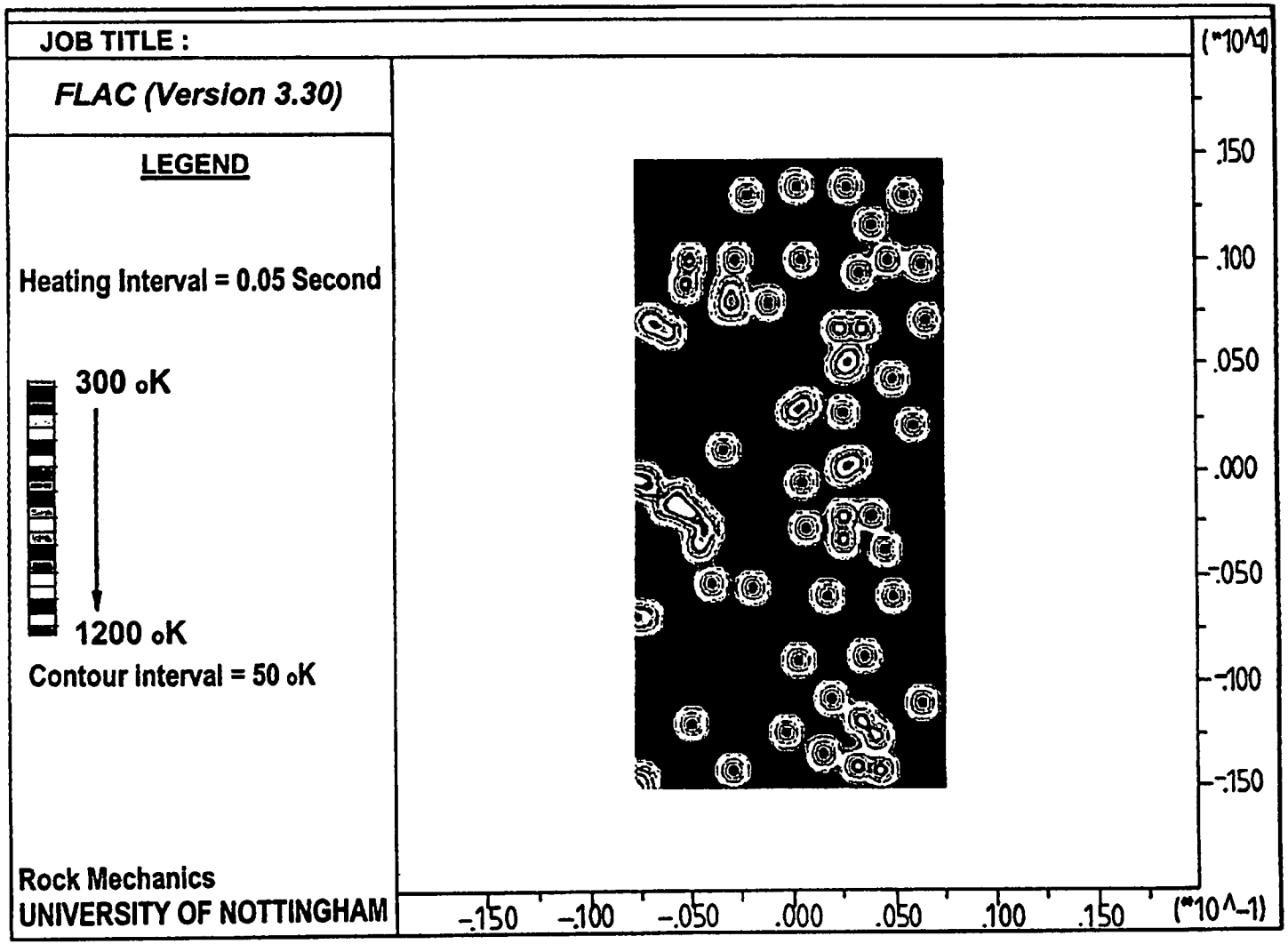
Figure 13B:
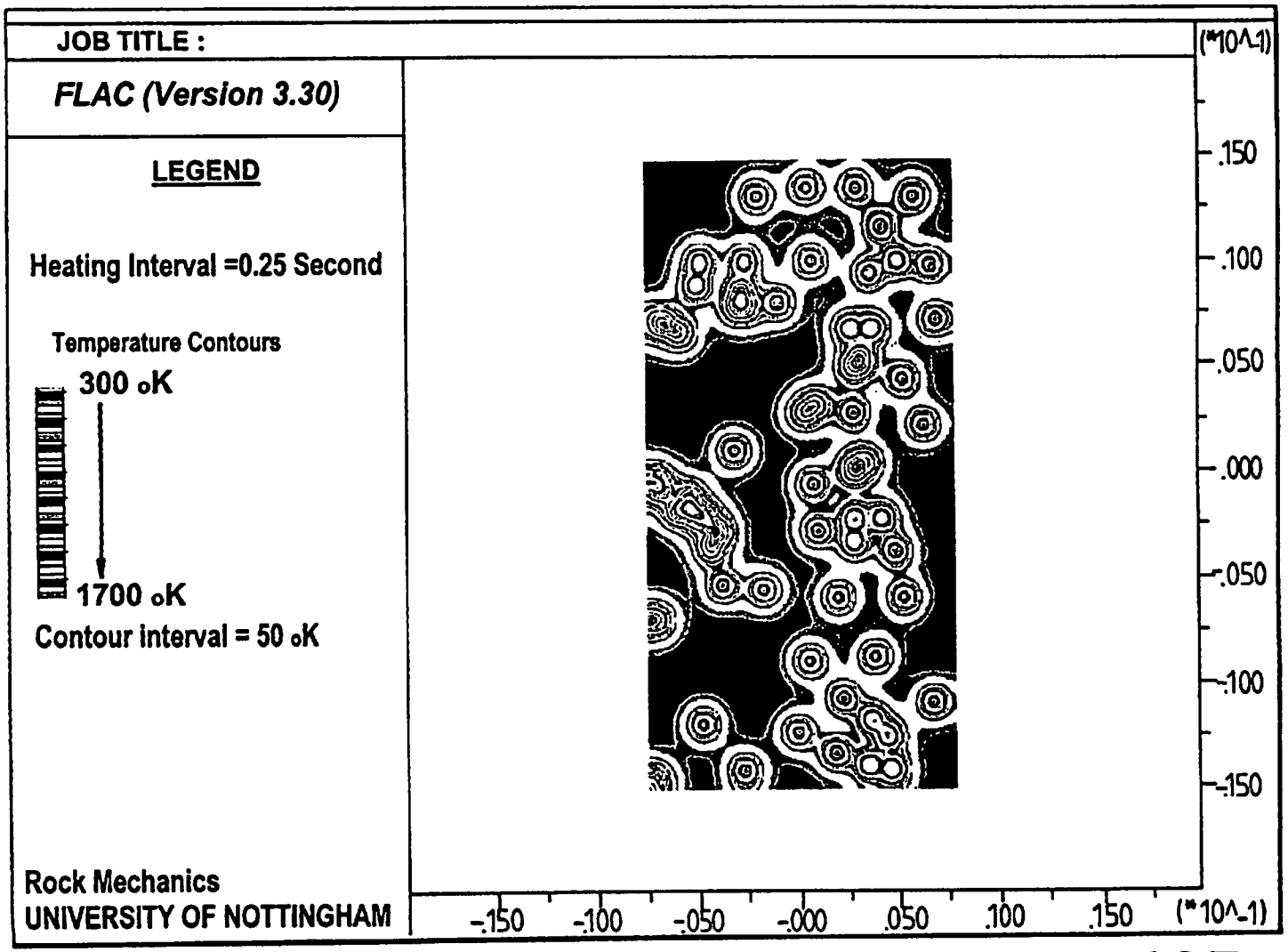
Figure 13C:
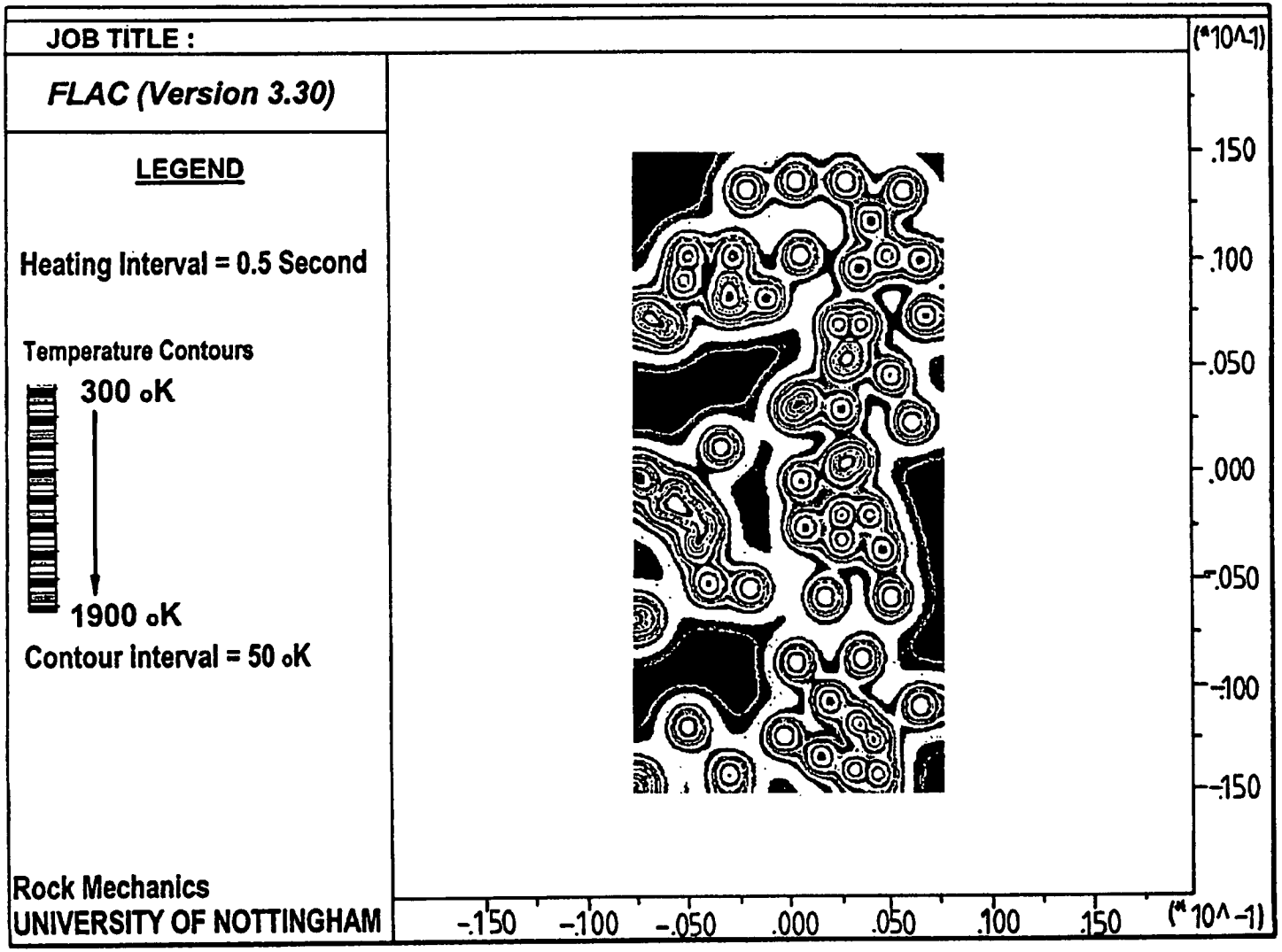
Figure 13D:
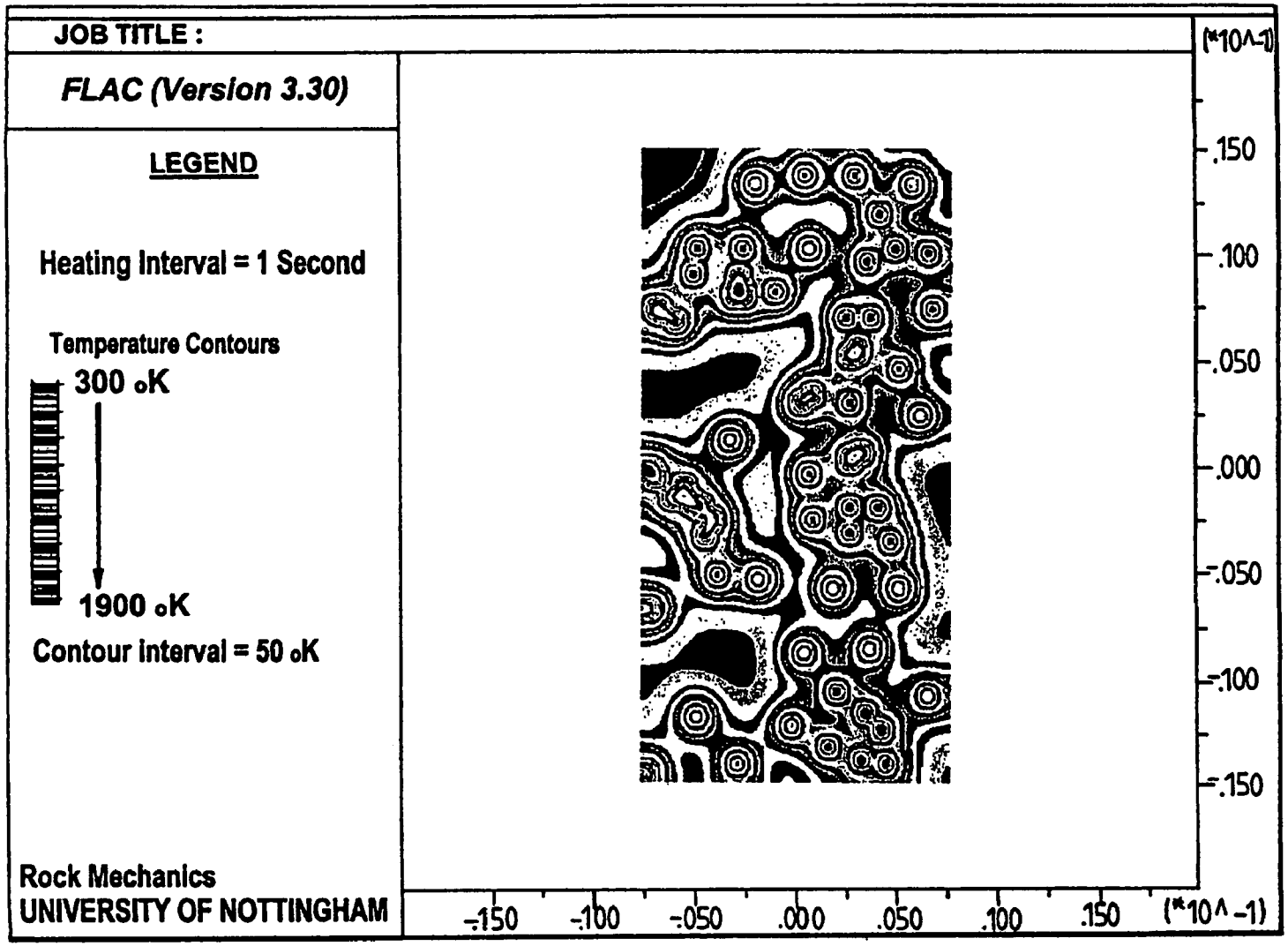
Figure 14:
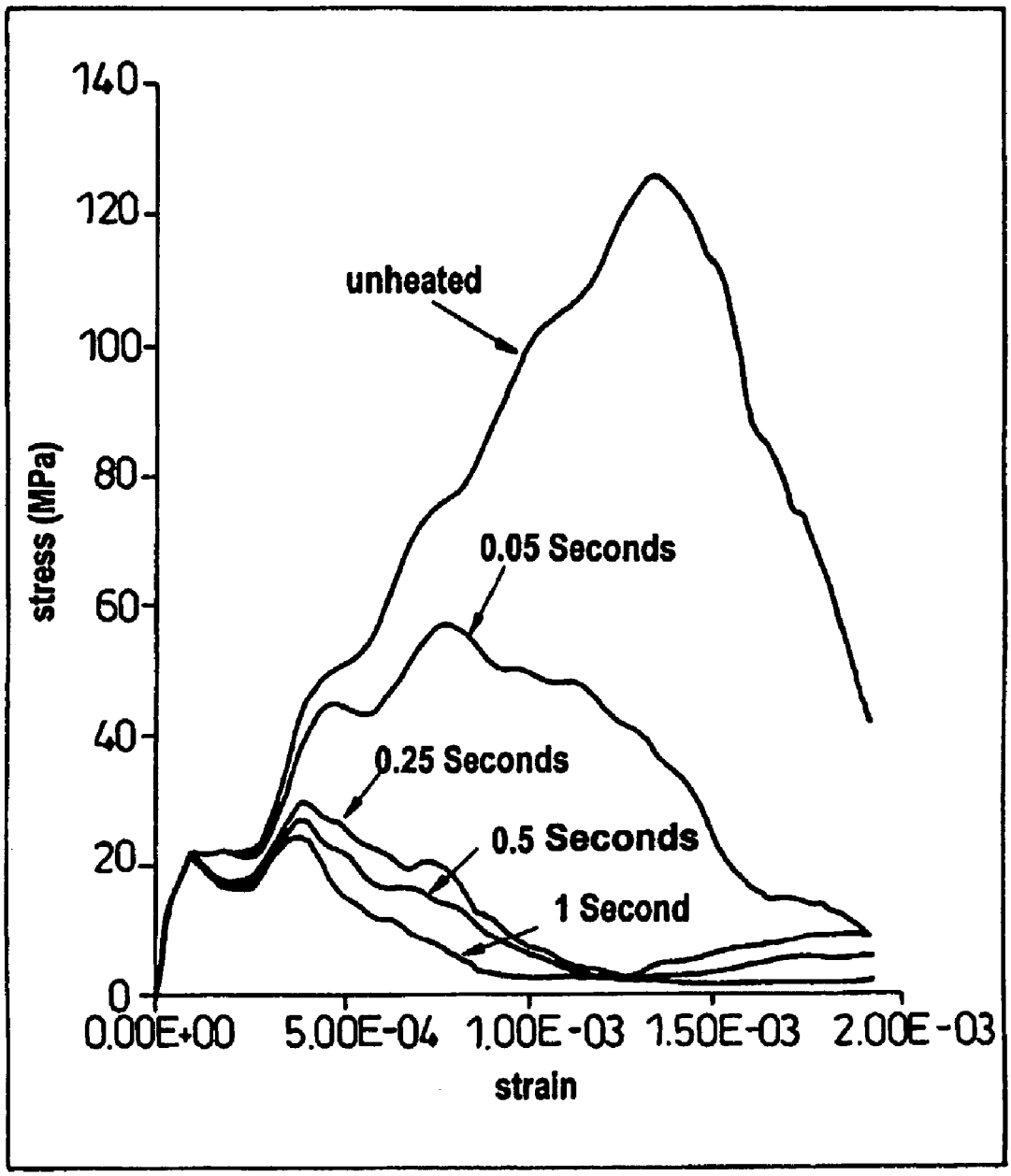
Figure 15:
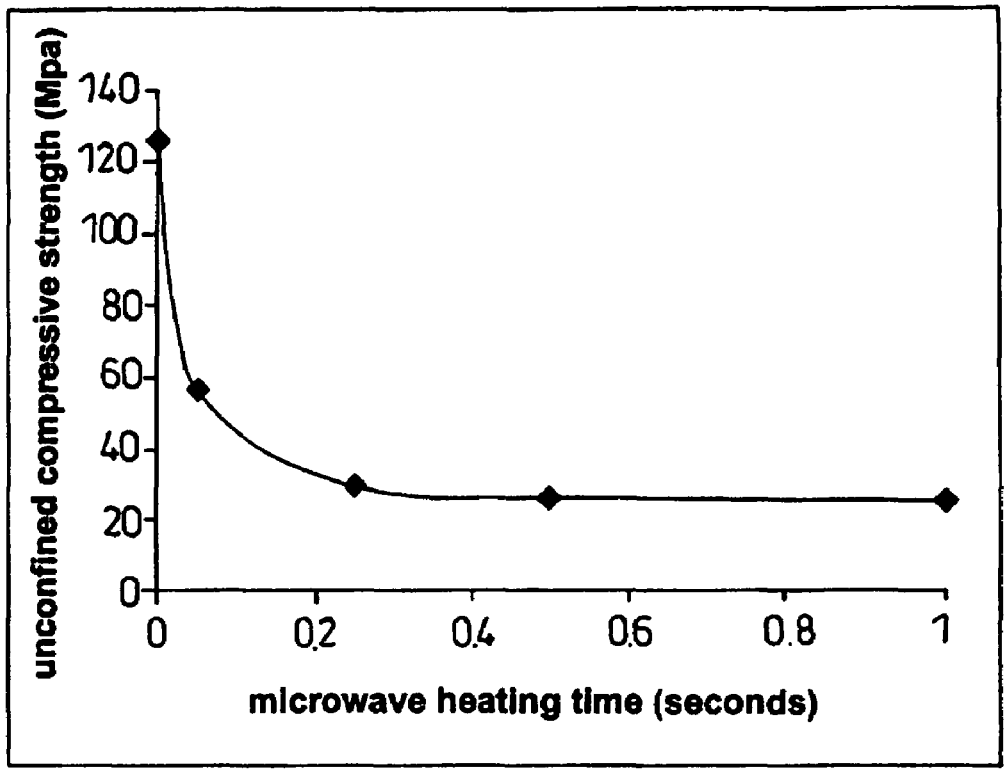
Figure 17:
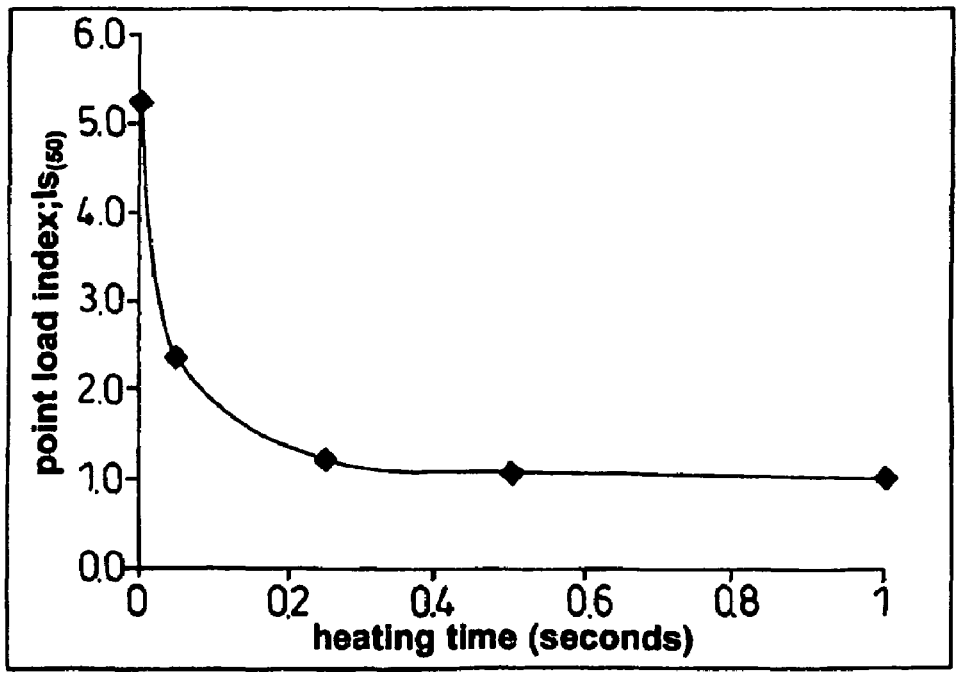
Figure 16A:
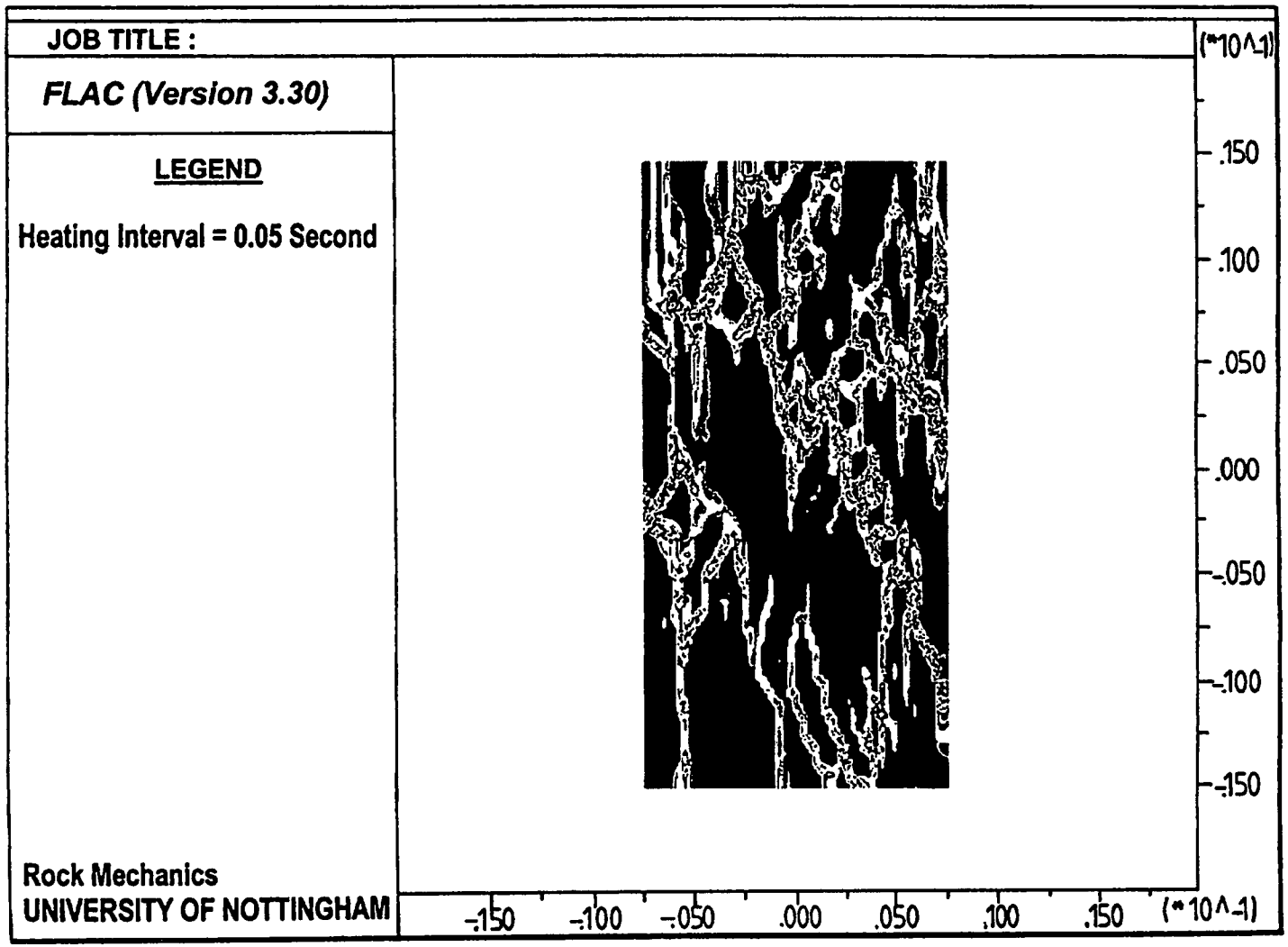
Figure 16B:
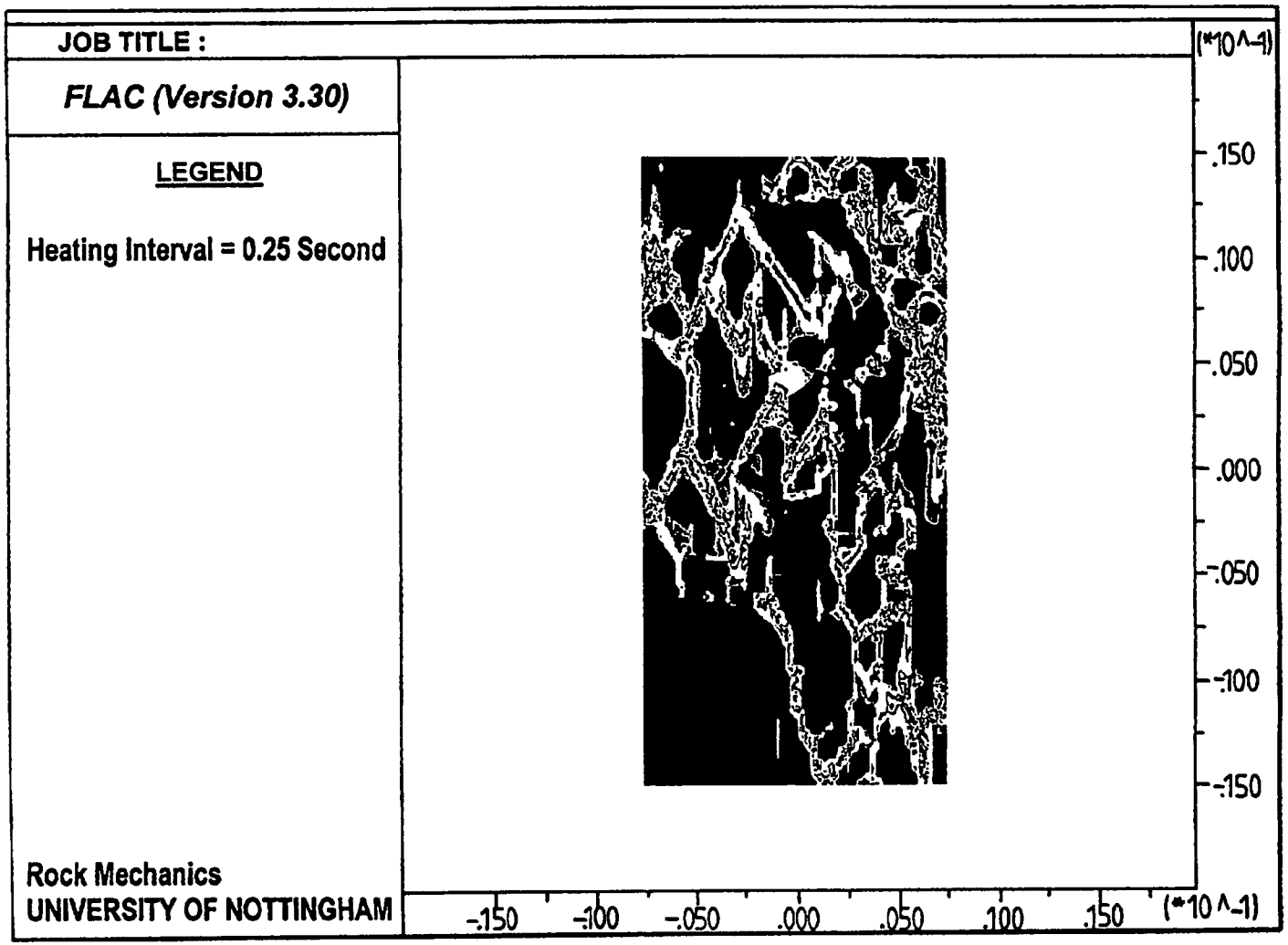
Figure 16C:
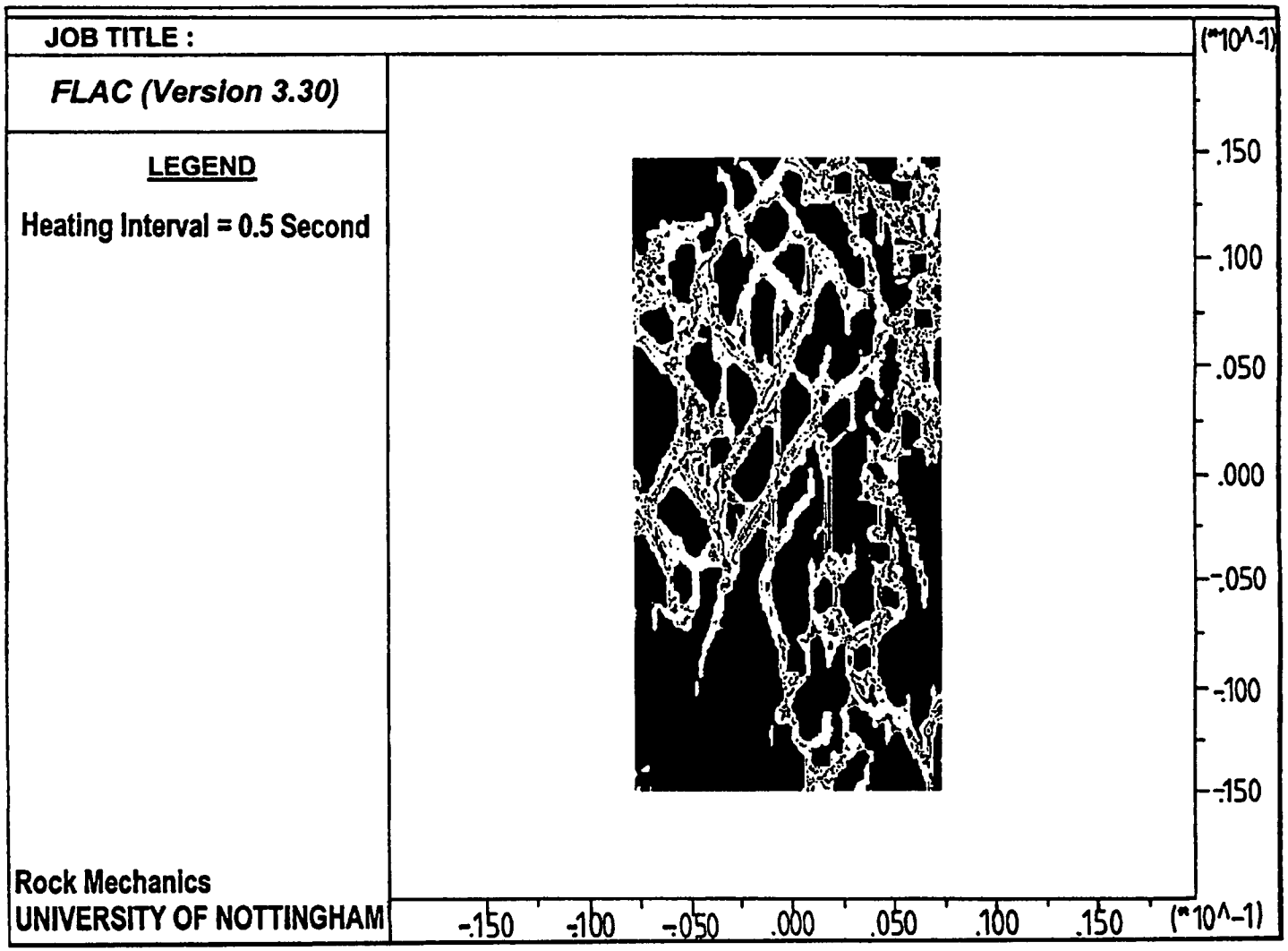
Figure 16D:
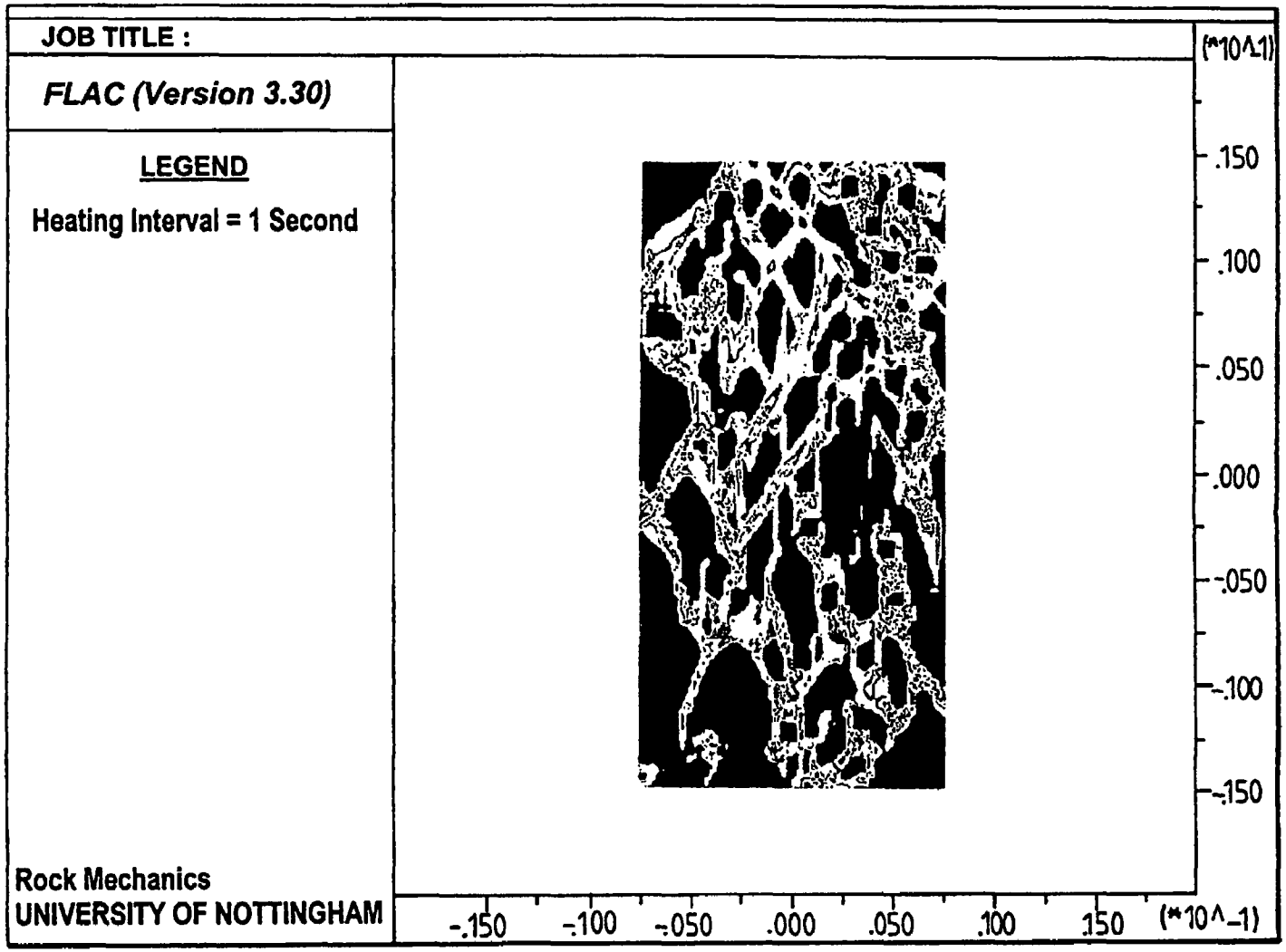
Figure 18:
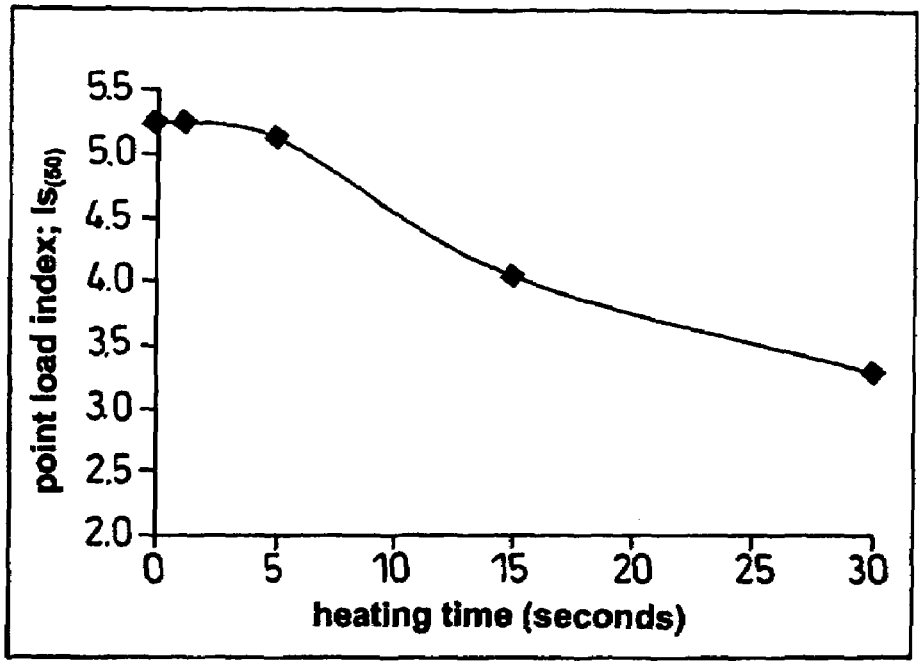
Figure 19:
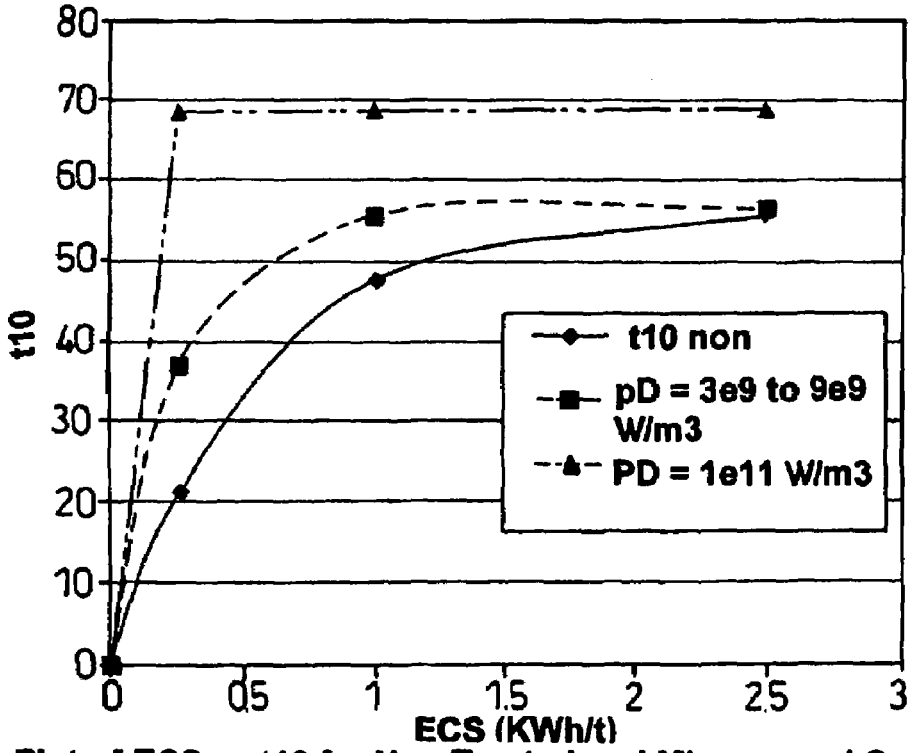
Figure 20A:
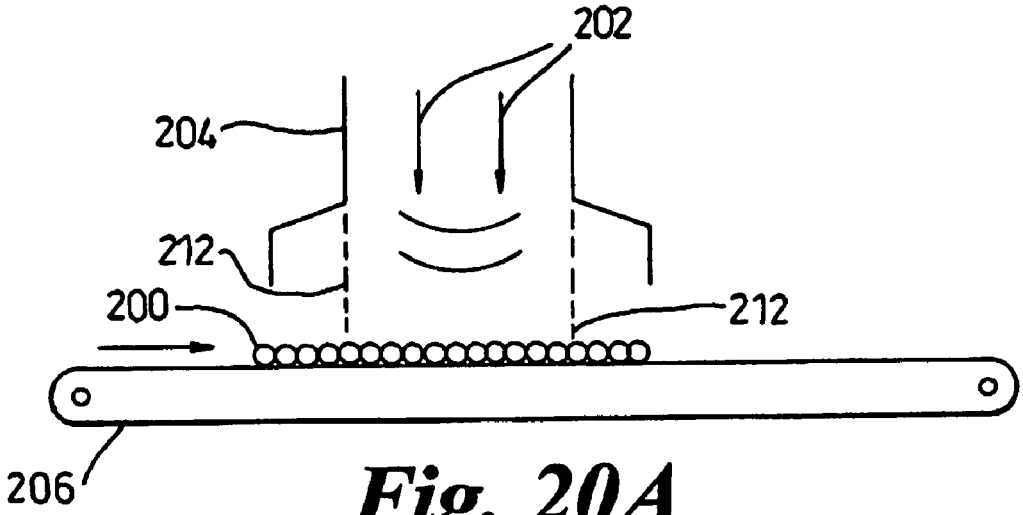
Figure 20B:
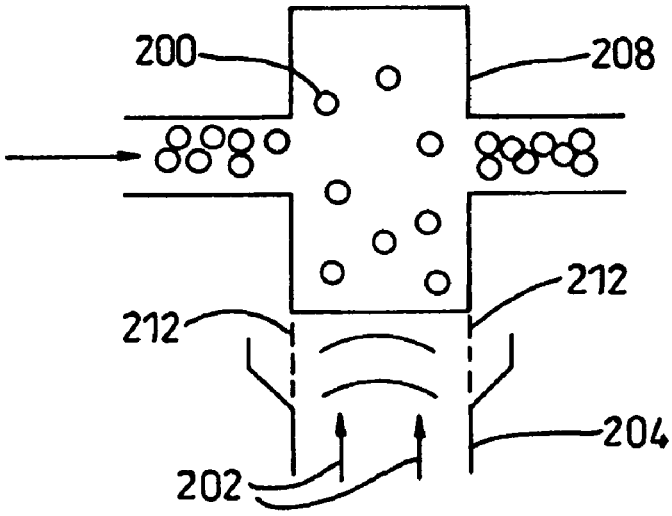
Figure 20C:
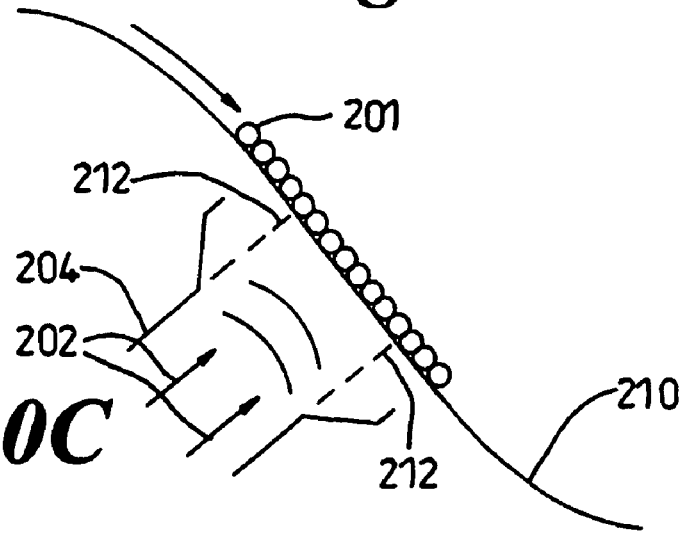

FIG. 5 schematically illustrates a model of a calcite and pyrite ore sample;

FIG. 6 illustrates dielectric loss factor versus temperature;

FIG. 7 illustrates variation of microwave power density versus temperature;

FIG. 8 illustrates the direction of simulated loading in a uniaxial compression test;

FIG. 9 illustrates temperature distributions of a 2.45 GHz, 2.6 kW microwave cavity;

FIG. 10 illustrates the effect of varying heating times;

FIG. 11 illustrates the effect of microwave heating time on unconfined compressive strength;

FIG. 12 illustrates shear plain development during unconfined compressive tests;

FIG. 13 illustrates temperature distribution for a microwave cavity with a power density of $10^{11}$ W per cubic meter;

FIG. 14 illustrates stress versus strain curves for different heating times;

FIG. 15 illustrates unconfined compressive strength versus heating time for a power density of $10^{11}$ W per cubic meter;

FIG. 16 illustrates shear plain development during unconfined compressive tests for power density of $10^{11}$ W per cubic meter;

FIG. 17 illustrates point of load index versus heating time for a power density of $10^{11}$ W per cubic meter;

FIG. 18 illustrates point of load index versus heating time for different power densities;

FIG. 19 illustrates t10 versus ECS;

FIGS. 20A to 20C show further variations of the unit of FIG. 3A;

Table 1 shows specific heat capacity as a function of temperature;

Table 2 shows thermal conductivity as a function of temperature;

Table 3 shows thermal expansion co-efficient as a function of temperature;

Table 4 shows mechanical properties of different minerals;

Table 5 shows the effect of different heating times on temperature and compressive strength of material;

Table 6 shows similar factors to Table 5, but for a higher power density;

Table 7 illustrates breakage parameters for a multimode cavity power density between $3\times10^9$ W per cubic meter and $9\times10^9$ W per cubic meter;

Table 8 shows breakage parameters for a single mode microwave cavity with a higher power density; and Table 9 is a list of references referred to.

FIG. 1*a* shows rock material 10 comprising crystals 12 of a first material embedded in a matrix 14 of a second material. An example of the first and second materials might be metal oxides (e.g. magnetite, ilmenite or haematite), or metal sulphides (e.g. copper, iron, nickel, zinc, or lead) as the first material, and possibly silicates, feldspars, or calcite as the second materials. It will be appreciated that these examples are non-binding and are illustrative only. There could be third, or fourth, or subsequent, materials 16 also present in the rock material 10. Thus, the rock material 10 comprises multiple phases of material having grain boundaries 18 between them.

FIG. 1*b* shows the rock material 10 after it has been treated with microwaves in accordance with the present invention. The crystals, or regions, of the first material 12 now have a weaker bond to the material 14, because the grain boundaries have been weakened due to the presence of cracks/dislocations/areas of stress and strain. These are referenced 20. In addition, there are also cracks 22 within the first material regions 12 and cracks 24 in the second material 14.

The precise nature of grain boundaries between two mineral phases in rock is not well understood, but it is suggested to be an area of disorder between two ordered species. If this were the case, then it would be sensible to assume that grain boundaries are an area of weakness. However, products of comminution suggest that grain boundaries are an area of strength (transgranular fracture being common in mineral processing operations) and can adversely influence liberation of one species from another. Thus, whilst theory might say that grain boundaries should be an area of weakness, practice in traditional comminution suggest that grain boundaries are particularly strong. However, it has been postulated that if microwave energy can induce micro-cracking around grain boundaries then reductions in required comminution energy and enhanced liberation of a valuable mineral would occur.

The reason why it is expected that cracks would occur at the grain boundary is due to the differential heating of the two material phases. They are expected to absorb energy from microwave differentially, and to change temperature at different rates, inducing thermal stresses. However, to date this has not really happened economically.

With the present invention, it has been realised that the reason why this has not happened is due to the temperature gradient not being large enough between the different phases of material. We have realised that to obtain a greater temperature gradient we should use a higher electric field strength/power density. The sort of power density we have in mind is perhaps of the order of $10^{16}$ $Wm^{-3}$, $10^{15}$ $Wm^{-3}$, or $10^{14}$ $Wm^{-3}$, or $10^{14}$ $Wm^{-3}$ (for example) for some applications. Depending upon the cavity design and dielectric of the material we may be generating electric fields of the order of $10^5$ $Vm^{-1}$ to $10^7$ $Vm^{-1}$, perhaps in the range of $0.05\times10^6$ $Vm^{-1}$. These figures are of course exemplary only and are non-binding and are not intended to be restrictive.

Numerical modelling has been undertaken using the geomechanical 2-D finite difference modelling software application, FLAC V3.3 (Itasca 1995). The model domain consisted an area representing a 15 mm wide by 30 mm high section, which was subdivided into individual square zones of 0.04 mm sides. The positions of the pyrite particles within the model domain were randomly generated to provide a relatively disseminated ore body, see FIG. 5. This type of dissemination has previously been shown to be responsive to microwave heating. It is appreciated that the 'mineralogy' or texture used for the modelling may be a simplified version of reality. However, the purpose of the investigation is to determine the influence of power density on the degree of strength reduction, not mineralogy. Therefore, as long as the mineralogy or texture is the same for both tests the data can be truly comparative. What is important, however, is that the simulated ore contains species that are both responsive and non responsive to microwave heating.

The finite difference modelling comprised of the 5 main stages given below and more fully described later:

1. Microwave heating of the two different mineral phases
2. Transient heat conduction during heating process between minerals
3. Determination of peak thermally induced stresses and strains
4. Modelling of thermal damage associated with material failure and strain softening
5. Simulation of uniaxial compressive strength tests to evaluate the reduction of unconfined compressive strength due to microwave heating.

Stage 1: Microwave Heating

The amount of thermal energy deposited into a material due to microwave heating (power absorption density) is dependent on the internal electric field strength, the frequency of the microwave radiation, and on the dielectric properties of the material.

The power absorption density per unit volume of the mineral can be approximated from Equation 1.

$$P_d=2.\pi.f.\in_o.\in''_r.E_o^2 \quad (1)$$

Where $P_d$ is the power density (watts/$m^3$)

f is the frequency of the microwave radiation (Hertz)

$\in_o$ is the permitivity of free space ($8.854\times10^{-12}$ F/m)

$\in''_r$ is the dielectric loss factor of the mineral $E_o$ is the magnitude of the electric field portion of the microwave radiation (volts/m)

Because the microwave absorption factor for calcite is substantially lower that that for pyrite no microwave heating of the calcite matrix was assumed during the modelling with selective heating of the pyrite particles only. The early work of Chen. (1984) and Harrison (1997) shows this assumption to be realistic.

The dielectric loss factor, $\in''_r$, for pyrite has been found to be dependant on temperature (Salsman 1995). In determining the power density for the pyrite the relationship between $\in''_r$ and temperature as shown in FIG. 6 was utilised (Salsman 1995).

For an initial series of models the power densities at various temperatures was obtained for the heating of pyrite within a 2.6 kW, 2.45 GHz multimode microwave cavity. The calculated power density varied between $3\times10^9$ watts/$m^3$ at 300° K and $9\times10^9$ watts/$m^3$ for temperatures greater than 600° K (FIG. 7) (Kingman 1998). The initial temperature of the ore body sample was taken to be 300° K.

Stage 2 Modelling of Transient Heat Conduction During Microwave Heating

The transient conduction of the microwave thermal energy during heating was modelled using an explicit finite difference method written as an algorithm.

The basic concept in the thermal conduction modelling was that a thermal energy flux may occur between a zone and its four immediately adjacent zones. The direction, i.e. into or out of the zone, and the magnitude of the thermal energy flux was dependent on the temperature gradient that existed between the zones and the conductivity of the zone. The boundary conditions were such that no thermal energy was lost from the material i.e. the material was assumed to be fully insulated.

The basic law that was used to determine the thermal energy flow between the zones was Fourier's law, which has been given as Equation 2:

$$q=K.T_{diff} \tag{2}$$

Where q is the heat flux vector in joules/sec/m

K is the thermal conductivity tensor in w/m.° C.

$T_{(diff)}$ is the temperature difference (° C.)

Thus the change in stored energy per time increment, Δt, is given by Equation 3

$$\Delta\beta=\Delta t.p \tag{3}$$

Δβ=Δt.q Where Δβ is the change in stored energy (Joules)

Expressing this in an explicit finite difference form for a square zone i,j with side length l:

$$\Delta\beta_{(i,j)}=\Delta t.K_{(i,j)}l[(T_{(i,j)}-T_{(i,j-1)})+(T_{(i,j)}-T_{(i,j+1)})+(T_{(i,j)}-T_{(i+1,j)})+(T_{(i,j)}-T_{(i-1,j)})] \tag{4}$$

Where $K_{(i,j)}$ is the thermal conductivity of zone i,j

Δt is the time increment in seconds l is the length of the sides of the zones $T_{(i,j)}$ is the temperature of zone i,j The relationship between thermal energy in joules and temperature in ° K for a given time increment, Δt, is given by Equation 5:

$$\Delta T_{(i,j)} = \frac{\Delta\beta_{(i,j)}}{m_{(i,j)} \cdot C_{(i,j)}} \tag{5}$$

where ΔT(i,j)=temperature change in zone i,j (° K)

m(i,j)=mass of zone i,j (Kg)

C(i,j)=specific heat of zone i,j (joules/Kg.K)

Thus at the end of each time increment the new temperatures of each zone due to thermal conduction and microwave heating are determined using Equation 6

$$T_{(i,j)}(1)=300°\ \text{K}\quad T_{(i,j)}(n+1)=T_{(i,j)}(n)+\Delta T_{(i,j)}+Pd_{(i,j)}/(C_{(i,j)}\Delta t) \tag{6}$$

Where $T_{(i,j)}(n)$ is the temperature of zone i,j at time increment n $Pd_{(i,j)}$ is the power density of zone i,j The microwave heating and thermal conduction for a specified heating time, ht, was simulated by recursively iterating Equations 4, 5 and 6 until Equation 7 was satisfied.

$$ht=n.\Delta t \tag{7}$$

Where: n time increment number

Δt is the time increment in seconds ht is the heating time in seconds

The time increment, Δt, was restricted to $2.5\times10^{-4}$ seconds to ensure numerical stability, which itself corresponds to a measure of the characteristic time needed for the thermal diffusion front to propagate through a zone.

The thermal conductivity and specific heat properties of calcite and pyrite vary with temperature (Harrison 1997) and have been included as reference in Tables 1 and 2.

Thermal/Mechanical Coupling

Stage 3 Thermally Generated Strains and Stresses

At the end of the heating interval the thermally induced strains within a zone, assuming perfect restrainment by the surrounding zones and isotropic expansion is given by Equation 8.

$$\in_{(i,j)}=-\alpha_{(i,j)}.(Tn_{(i,j)}-T1_{(i,j)}) \tag{8}$$

Where $\in_{(i,j)}$ is the strain in zone i,j $\alpha_{(i,j)}$ is the thermal expansion coefficient (1/° K) of zone i,j $Tn_{(i,j)}$ is the final temperature of zone i,j $T1_{(i,j)}$ is the initial temperature of zone i,j The thermal expansion coefficient for pyrite and calcite has also been found to be temperature dependant (Harrison 1997). Table 3 outlines the thermal expansion coefficient at various temperatures for calcite and pyrite as assumed and implemented within the modelling.

The calculated thermally induced stress within a zone can then be determined using Hoek's law for isotropic elastic behaviour (Equation 9).

$$\sigma_{(i,j)} = \frac{\varepsilon_{(i,j)} \cdot E_{(i,j)}}{(1-2\cdot\upsilon_{(i,j)})} \tag{9}$$

Where $\sigma_{(i,j)}$=isotropic thermally induced stress within zone i,j assuming perfect restrainment $E_{(i,j)}$=Young's Modulus of zone i,j $\upsilon_{(i,j)}$=Poisson's Ratio of Zone i,j Redistribution of Thermally Induced Stresses To obtain a state of static mechanical equilibrium throughout the domain of the material a redistribution of the thermally induced stresses and strains was necessary. To obtain the equilibrium distribution the model was stepped in FLAC's default calculation mode for static mechanical analysis. This default mode performs an explicit time-marching finite difference calculation utilising Newton's law of motion to relate nodal strain rates, velocities and forces (Itasca 1995). The material was assumed to behave as a linear isotropic elastic medium with mechanical properties determined by the Young's Modulus, Poisson's Ratio and density (Table 4).

Stage 4 Modelling of Thermal Damage Associated with Material Failure and Strain Softening When static equilibrium was obtained, modelling of the brittle fracture, where the stresses exceeded the strength of the material, was undertaken by simulating the constitutive behaviour of the ore body as an elasto-plastic material with plastic strain softening. The strength of the material was approximated as a very strong brittle crystalline limestone with an unconfined compressive strength of 125 MPa and a shear strength related by a linear Mohr-Coulomb strength criterion (Equation 10).

$$\tau=\sigma_n.\tan\phi+c \tag{10}$$

Where τ is the shear strength $\sigma_n$ is the normal stress acting normal to the shear plane ϕ is the friction angle of the material c is the cohesive strength of the material Upon failure the material was assumed to behave as a brittle linear strain softening medium undergoing plastic deformation with a final residual strength being obtained after 1% strain (Table 4).

Stage 5 Simulations of the Unconfined Compressive Strength Tests on the Thermally Damaged Samples The effect of thermal heating on the unconfined compressive strength and fracture development within the modelled material was predicted by the simulation of the uniaxial compressive strength test on the thermally damaged models (FIG. 8).

The simulation was undertaken as a plane strain analysis with the material being considered as continuous in the out of plane direction. The simulation was undertaken by applying a constant velocity to the grid points positioned at the top and base of the model domain whilst the left and right boundaries where unstrained. This is analogous to a displacement controlled uniaxial compressive strength test. To monitor the load-deformation relationship within the samples during testing, history files were generated of the average stress conditions at the top and bottom boundaries. The models were run until approximately 0.2% axial strain of the sample whereupon the models predicted failure strength and some strain softening details of the samples was obtained.

Results of the Numerical Modelling

Microwave Heating Times

To determine the effect of microwave heating on the strength of the calcite and pyrite ore, numerically modelling was undertaken for an unheated sample and for samples with microwave heating times of 1 second, 5 seconds, 15 seconds and 30 seconds. It was assumed that the samples were treated in a multimode microwave cavity with a power density that varied from $3\times10^9$ watts/m$^3$ at 300° K to $9\times10^9$ watts/m$^3$ for temperatures greater than 600° K.

Temperature Distributions

The modelled temperature distributions for each of the four time intervals is shown in FIG. 9. It can be seen from the Figure that the highest temperatures and temperature gradients were generated where the pyrite particles were clustered. Table 5 summarises the temperature distributions within the modelled samples for each temperature increment.

Due to the length of time required to heat the pyrite particles within the 2.6 kW microwave cavity, conduction of the deposited thermal energy from the pyrite into the surrounding calcite host was predicted to occur. After 30 seconds of microwave heating time the calcite host had been heated to greater than 600° K. This conduction can be seen to reduce the temperature gradient generated within the ore sample and thus reduce the thermally generated stresses within the sample.

Effect of Microwave Heating on the Unconfined Compressive Strength

The effect of the microwave treatment on the unconfined compressive strength of the ore sample has been illustrated in FIG. 10 and summarised in Table 5. FIG. 11 shows the unconfined compressive strength of the ore material plotted against microwave heating time and indicates that the heating intervals of 1 and 5 seconds had little affect on the unconfined compressive strength of the material. A more noticeable reduction in strength was predicted with microwave heating times of 15 and 30 seconds. This observation may be attributed to the fact that the rate of heating was insufficient to induce localised thermal gradients of a magnitude that would generate thermal stresses that exceed the strength of the ore material. Thus the modelled reduction in strength of the ore body may be attributed to the differential expansion of the pyrite and calcite material, due to different thermal expansion coefficients, generating stresses that exceed the strength of the sample.

Pattern of Shear Planes

Also of interest was the pattern of the simulated shear planes developed within the modelled samples after the unconfined compressive tests. These patterns have been shown as FIG. 12 for the samples with microwave heating times of 1, 5, 15 and 30 seconds. The fracture patterns developed within the microwave heated samples were similar to the fracture patterns displayed by the unheated sample i.e. consisting mainly of continuous shear planes inclined at approximately 25° to the direction of loading.

Effect of Increasing the Microwave Power Density

Power Density and Heating Time Intervals

To assess the effect of increasing the microwave power density on the temperature distribution, unconfined compressive strength and shear plane development within the ore samples a microwave power density of $1\times10^{11}$ watts/m$^3$ was assumed for the pyrite material. This power density was approximately 10 to 15 times greater than the power density generated by using the 2.6 kW 2.45 GHz microwave cavity, although still easily within the range that can be achieved by microwave heating of pyrite in a single mode cavity (Salsman 1995). It is assumed that this power density is achieved by a single mode cavity supplied with microwave energy at a power level of 15 kW at 2.45 GHz (at this power this level of power density is easily achievable). The calcite host material was considered to be unheated by the microwave energy. Due to the higher power density much shorter heating times of 0.05, 0.25, 0.5 and 1 second were considered.

Temperature Distributions

The modelled temperature distributions within the ore samples for each of the four time intervals are shown as FIG. 13. The Figure illustrates that significantly greater temperatures were generated within the pyrite particles. The shorter heating times compared to the 2.6 kW microwave cavity reduced the degree of thermal conduction, thus reducing the amount of heating of the calcite matrix. This generated temperature gradients of a significantly higher magnitude within the ore samples. The temperatures within the ore samples obtained by the modelling have been summarised in Table 6.

Effect of Microwave Heating on the Unconfined Compressive Strength

The effect of the microwave heating on the unconfined compressive strength of the ore samples is illustrated in FIG. 14. Compared to the reduction in strength within the 2.6 kW cavity it can be seen from FIG. 15 that that the higher power density generates a considerably larger reduction in strength, with the majority of the strength reduction occurring very quickly (within 0.05 seconds of microwave heating). The results of the modelling have been summarised in Table 6.

Pattern of Shear Planes

The pattern of shear planes developed within the ore samples after the simulated uniaxial compression test, for the 0.05, 0.25, 0.5 and 1 second heating intervals are shown as FIG. 16. The Figure indicates, unlike the unheated and 2.6 kW cavity heated samples, that the shear planes are irregular and concentrated along the grain boundaries between the pyrite and calcite. This may be attributed to the high thermally induced stress that develop along these boundaries due to the rapid localised heating and expansion of the pyrite particles within the relatively unheated calcite matrix.

Discussion

The influence of microwave power density on a theoretical ore has been demonstrated. The numerical simulation has shown very clearly that if the preferential dielectric material can be made to absorb the majority of the applied energy significant reductions in compressive strength can be achieved. To further illustrate this in the context of comminution the extremely well known relationships developed by (Broch and Franklin, 1972 and Bieniawski, 1975) were used to calculate the point load index ($Is_{(50)}$) from the modelled UCS data. The equation used was:

$$I_s(50)=\mathrm{UCS}/K \tag{11}$$

Where $I_s(50)$=Point load strength corrected to 50 mm core.

K=24

UCS=Uniaxial compressive strength

The results of this analysis are shown in FIGS. 17 and 18. FIG. 17 shows the influence of microwave heating time versus point load index for the lower power density. It can clearly be seen that as microwave exposure time is increased the point load index decreases significantly. This is also true in FIG. 18, which shows microwave heating time versus point load index for the ore exposed to the higher density. As for the UCS tests in FIGS. 11 and 15 the reductions in point load index are particularly significant at the higher power density with a reduction from 5.25 for non-treated to 1.25 after just 0.2 seconds.

Point load index is of particular interest to the mineral processing engineer because it allows rapid prediction of the relationships between Ecs (Specific comminution Energy KWh/t) and $t_{10}$ ($t_{10}$ is the percentage passing $1/10^{th}$ of the initial mean particle size) (Bearman et al 1997). The $t_{10}$ can be interpreted as a fineness index with larger values of $t_{10}$ indicating a finer product. However, in practise the value of $t_{10}$ can be used to reconstruct the size distribution of the broken ore. The $t_{10}$ value is related to the specific comminution energy by the following equation (Napier-Munn et al. 1996):

$$t_{10}=A[1-e^{(-b.ecs)}] \tag{12}$$

Where A and b are material specific breakage parameters. A is the theoretical limiting factor of $t_{10}$ and b is the slope of the ECS versus $t_{10\,plot}$. Determination of A and b for a specific material can lead to calculation of a specific size distribution for a specific energy input.

It has previously been shown that point load index is intimately related to Mode 1 fracture toughness (Bearman 1999). Bearman showed that $$K_{ic}=0.209I_{s(50)} \tag{13}$$

Where $K_{ic}$=Mode 1 Fracture Toughness ($MN/m^{3/2}$)

Mode 1 fracture toughness has also been shown to have highly significant correlation with the breakage parameters A and b (Bearman et al 1997).

It was shown that:

$$b=2.2465\times K_{IC}^{-1.6986} \tag{14}$$

$$A.b=126.96\times K_{IC}^{-1.8463} \tag{15}$$

Table 7 shows the calculation of the breakage parameters for the theoretical ore exposed to the 2.6 kW microwave radiation for times of 0 10 and 30 seconds. Table 8 shows the calculation of breakage parameters for the same ore treated at the higher power density. This data was used in conjunction with Equation 11 to calculate the influence of ECS on $t_{10}$. Energy inputs of 0, 0.25, 1 and 2.5 kWh/t were used for the calculation. For clarity data is only presented for the non-treated and the most extreme treatment times i.e. 30 seconds and 0.02 seconds. FIG. 19 shows the influence of power density on the ECS v $t_{10}$ graph. It can be seen that as power density is increased the slope of the plot increases significantly and the theoretical limiting value of $t_{10}$ is reached for a much lower energy input. Put simply this means that theoretical ore treated at the lower power density produces a much coarser product for a set specific comminution energy input than that treated at the higher power density. If it is assumed that the mass of material heated is 1 kg the sample energy input for each case is for 2.6 kW treated sample heated for 30 seconds in the multimode cavity:

$$2.6\times0.5/60\times1000/1=125\ \mathrm{kWh/t}$$

and for the 15 kW treated sample heated in the single mode cavity for 0.2 seconds:

$$15\times3.33\times10^{-3}/60\times1000/1=0.8325\ \mathrm{kWh/t}.$$

This clearly shows the influence of power density on the comminution of ores.

The purpose of this discussion has been to illustrate the influence of power density (or electric field strength) on the comminution of minerals. It is appreciated that the texture used for the modelling stage is not exactly like a 'real' ore. However, the ore has behaved in a similar manner to real ores previously tested (Kingman et al. 2000). Also the values obtained for the breakage parameter A are similar to those expected for a typical hard rock ore (Napier Munn 1996). It has been shown that increasing the power density the significantly greater stresses are created for much lower energy inputs. This has significant ramifications for the development of microwave assisted comminution flowsheets. It is concluded that the use of high power density cavities makes the microwave treatment of minerals economic, especially when coupled to the additional benefits of thermally assisted comminution.

The references discussed are in Table 9.

The above theoretical discussion, which we are the first to realise has significance, has been followed up with actual trials of short duration, high field strength, standing wave microwaves on rock samples and they do indeed break along crystal boundaries. Cracks have been seen along grain boundaries—which is very encouraging.

What we have realised is that the previous treatment of minerals has used standard multi-mode microwave cavities, similar to those found in conventional microwave ovens. Whilst a multi-mode cavity is mechanically simple, it suffers from poor efficiencies and relatively low electric field strengths. We have concluded that high electric field strengths are vital to high power absorption and vital to causing cracking/weakening at the grain boundaries. We have concluded that it is not appropriate to "gently" heat the different phases because that allows time for temperature gradients to be smoothed out. What we want is for a large temperature gradient to be created quickly, so as to induce greater strain/stresses at the grain boundaries. This is achieved better by having high power density microwave radiation.

One way of achieving this is by not having standard multi-mode cavities, but rather having single mode cavities. These particularly comprise a metallic enclosure into which a microwave signal of correct electromagnetic field polarisation is introduced, and undergoes multiple reflections. The superposition of the reflected incident waves gives rise to a standing wave pattern that is very well defined in space. The precise knowledge of the electromagnetic field configurations enables a dielectric material of the rock/other material being treated to be placed in the position of maximum electrical field strength, allowing maximum heating ranges to be achieved. Single mode cavities are not as versatile as multi-mode cavities, but we have realised that by going against traditional preferences for multi-mode cavities and using single mode cavities, we can achieve much higher field strengths. Moreover, it is possible to tune a single mode cavity so as to present the maximum field strength area in a position where it is wanted in the treatment process plant.

However, single mode cavities/positioning material at maximum field strength positions becomes unnecessary if multi-mode type cavities that enable creation of sufficient power density are available, and they are now. Thus we prefer multi-mode type cavities provided the power density created within them is high enough.

Indeed, by having very high field strengths, we can heat materials that are traditionally thought to be transparent to microwaves.

By having a power density that is much higher (e.g. $10^{15}$ $Wm^{-3}$) than traditionally achieved in multi-mode cavities, we achieve, very quickly, much higher thermal gradients across grain boundaries than previously achieved.

We have observed in trials 50%, and even 60% changes in strength with exposure times of less that 0.1 seconds. We have proved the principle that it is not necessary to have tens of seconds of exposure to microwaves to get what is wanted.

FIG. 3A illustrates a single-mode microwave cavity 30. In this example it is suitable for processing minerals. Minerals, schematically illustrated at 32, enter a microwave pre-treatment zone 34 via an input channel 36. In the example shown in FIG. 3, the arrangement is vertical, and the mineral lumps/pieces 32 (which may typically be up to about 15 cm in maximum dimension) fall under gravity through the input channel 36, through the pre-treatment zone 34, and out beyond it through an exit channel 38. The arrangement can be vertical, or inclined to the vertical (for slower feed rate of minerals), or even horizontal.

A microwave emitter 40 is provided in a microwave chamber 42, with the flow of minerals 32 passing through the microwave chamber 42, passing through the pre-treatment zone 34.

A reflector, or microwave short-circuit tuner, 44 is provided disposed opposite to the microwave emitter 40. Another reflector 46 is provided at the microwave emitter 40 (this reflector 46 may be optional). Microwave reflecting surfaces 48 also line the chamber 42.

Microwave emitter 40 emits microwaves, schematically illustrated as 49*a*; typically of 2.45 GHz, or 915 MHz (typically available microwave magnetron frequencies). It may emit them continuously, or in pulsed mode. The microwaves are reflected back from reflector 44 and the reflected waves, schematically illustrated as 49*b* interfere with the forward waves emitted by the emitter 40 and set up a standing wave pattern. This standing wave pattern has at least one maxima 52 (area where the power density is at a maximum) and minima (areas where the power density is at a minimum).

Because maximum electric field strength is desired, so as to achieve the fastest rate of heating of different materials and hence the fastest differential heating, we ensure that the maxima 52 is at the place where the minerals 32 pass through the pre-treatment zone 34. Alternatively, put another way, we ensure that the materials 32 pass through the treatment zone 34 at a place where the field strength is highest/high enough. We can control either, or both, of where the maxima occur, and where the material is disposed in the cavity. There may be only one maximum in the standing wave.

We have a microwave generating device, and apply microwave energy through a waveguide to a cavity, and couple and tune the cavity to the microwave generating device (magnetron) to maximise electric field strength in the area where the material to be treated is to be found in the cavity.

Figure 3B:
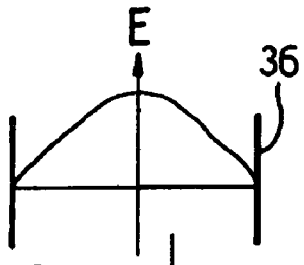
FIG. 3B shows how electric field varies across the material inlet of the unit of FIG. 3A.

FIG. 3B shows how the electric field strength experienced in the cavity varies across the region of the cavity that is registered with the entrance channel 36. As will be seen, the electric field strength is higher towards the middle cavity/aligned with the middle channel 36, than at the edges. This is due to constructive interference in the standing wave that has been set up.

Figure 4A:
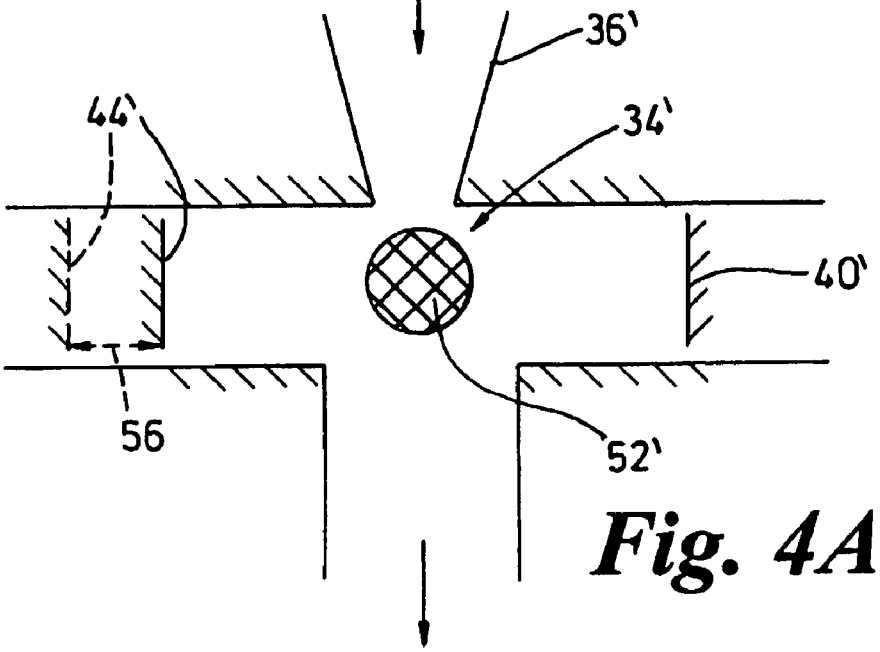
FIGS. 4A and 4B show variations of the unit of FIG. 3A.

FIG. 4*a* shows an embodiment similar to FIG. 3, but where the input channel 36' directs materials being input into the treatment zone 34' specifically to a place where the standing wave of microwaves has a maxima 52'. In the example of FIG. 4*a*, the mechanism for directing the flowing material through the position of maximum field of strength is a funnel-shaped channel which has an outlet adjacent the maxima 52'. Existing microwave machines can produce only one standing wave, with a single maxima. This may or may not be true in the future.

FIG. 4*a* also shows, conceptually, the ability to tune the standing wave in the cavity/treatment zone 34' to control the position of the maxima. This is schematically shown by having reflector plate 44' be movable relative to the source of the microwaves 40'. The movable nature is shown by dotted alternative positions for the reflector 44', and arrow 56, which illustrates movement of the reflector.

Figure 4B:
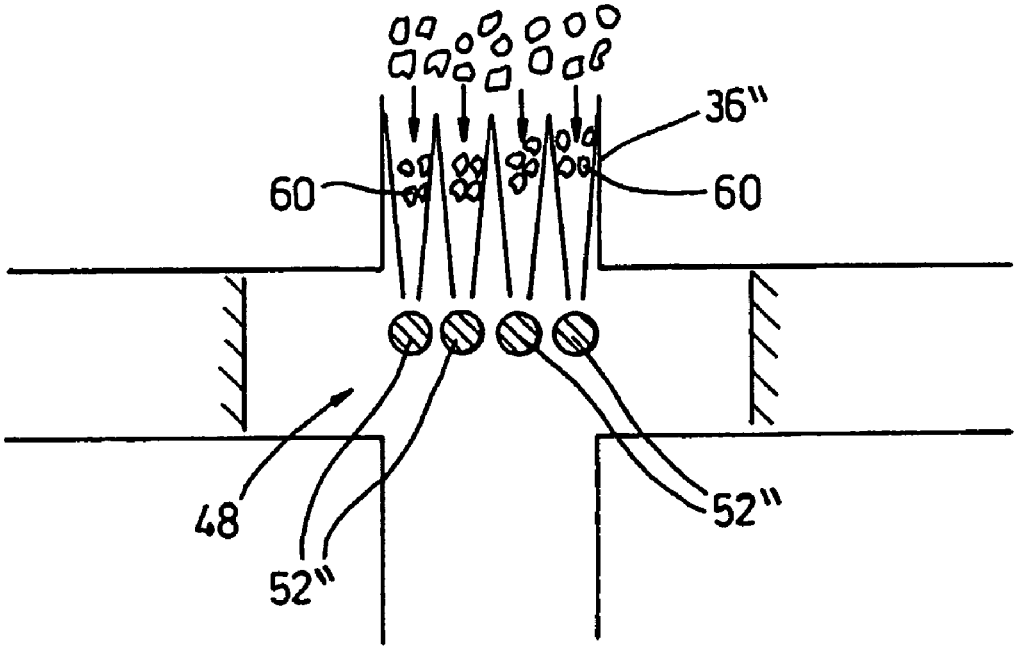

FIG. 4*b* is also relatively fanciful at present (since it is not known how to produce a standing wave as shown) but it schematically illustrates an alternative arrangement were the input channel 36" has a number of guide formations 58, which divide flowable material flowing through the treatment zone into different streams, referenced 60, each of which encounters a different maxima 52" of the standing wave set up in the microwave cavity. It will be appreciated that it is possible to do this by having funnels whose outlets correspond with maxima of the standing wave. If it were possible to have a plurality of maxima then we could do as suggested. That may be available in the future.

The power of the microwave emitter is between 1 and 100 kW, in this example it is 15 kW. The power density of the microwave emitter is between $10^9$ watts per cubic meter and $10^{15}$ or $10^{16}$ watts per cubic meter. It may be possible to go higher that $10^9$ watts per cubic meter in power density, but there is a potential for higher power densities to cause electric field breakdown of air within the material, which may be detrimental (or which may not be detrimental).

We may prefer to have the size of the "lumps" passing through the treatment chamber to be not too large (for example less than 20 cm or less than 15 cm in largest dimension).

FIG. 20A illustrates schematically an alternative to FIGS. 3A, 4A and 4B for a method of moving minerals 200 through a region for microwave treatment. Minerals 200 are placed on a conveyer belt 206 which continuously feeds the minerals 200 underneath a horn 204 and through the zone in which microwaves are present, denoted by dotted lines 212. The speed of the conveyer belt is set so as each piece of mineral has an exposure time (residence time in the microwave zone under the horn 204) of 1 ms and the process has a throughput of 1000 tonnes of mineral per hour. The microwave emitter produces four 1 μs pulses of radiation at a frequency of either 433 MHz, 915 MHz or 2.45 GHz every 1 ms, meaning that each piece of mineral is subjected to four 1 μs pulses of microwave radiation. An electric field strength approaching 30 $kVcm^{-1}$, which is the field strength at which air breaks down, is created between the dotted lines 212. We need, in many embodiments to be below the electric field strength at which air breaks down.

In other examples 10 pulses, or 50, or 100, or more pulses may be experienced by the ore in the time it takes to traverse the microwave zone.

FIG. 20B illustrates schematically an alternative method of transferring minerals 200 through an area of microwave radiation denoted by dotted lines 212. A pneumatic pump is used to propel the minerals 200 through the area of microwave radiation 202 at a speed of up to 12 $ms^{-1}$. The speed of flow may be controllable. This enables a shorter exposure time to the microwave radiation 202 than is possible with a conveyer belt and a higher throughput is achievable. In this example five 0.5 μs pulses of microwave radiation of frequency 915/896 MHz are used to create the required power density of the order of $10^{15}$ $Wm^{-3}$. This raises the temperature of the mineral as a whole by approximately 15° C., although a temperature gradient of the order of tens, or several tens of ° C., or 100-150° C. or so is created across the grain boundaries, which enables the mineral to be extracted in a downstream process with less energy than before.

FIG. 20C illustrates schematically another alternative method of passing a mineral, in this example coal 201, through an area of microwave radiation denoted by the dotted lines 212. The coal 201 is continuously placed at the top of a slide 210 and is moved through the area of microwave radiation under gravity. The exposure time can be varied by altering the gradient and length of the slide 210. In this example a single 1 ms pulse of microwave radiation of frequency 433 MHz is used to dehydrate the coal. In this example the coal is dried, and the post-microwave process comprises burning the coal.

FIG. 2A shows a comminution plant 100 having an ore sizing mechanism 102 which is adapted to ensure that ore leaving the sizing mechanism is of a predetermined maximum size, or range of sizes; a microwave pre-treatment/weakening unit 104 which comprises a unit such as that of FIG. 3 or FIG. 4A or FIG. 4B or FIGS. 20A, 20B or 20C; a rod mill 106, a first ball mill 108, a first hydrocyclone 110, a second ball mill 112, and a second hydrocyclone 114.

It will be appreciated that items 106 to 114 are prior art, and that the key differentiation from the prior art is the microwave treatment unit 104. However, it will be noted that microwave treatment unit 104 is a weakening unit, and that mechanical comminution is still performed after weakening the ore. It will be noted that it may be necessary, or perhaps not necessary, to mechanically condition/size the ore before it is microwaved in the unit 104.

It is desired in some examples to achieve a temperature gradient of between 100 and 1500° C. across the grain boundary of a material of the first phase and the material of the second phase, so as to try to induce weaknesses/cracks at the grain boundary. In other examples we can achieve the fracturing/weakening we seek with lower temperature gradients, for example perhaps 15-20° C., provided we induce these gradients fast enough. The speed at which the temperature gradient is set up can enable us to use lower temperature gradients than previously thought possible. A temperature gradient of a few tens of ° C. may be enough if very short (e.g. of the order of microsecond) microwave pulses are used.

We realise that the change in strength of the material is a function of power density, that the temperature gradient is a function of power density, that the shear strain is a function of temperature profile, that the shear stress is a function of the shear strain, and that failure will occur when the shear strain in the material exceeds the shear strength of the material. Thus, failure/weakening of the material is intimately associated with power density (obviously assuming that the material contains a mixture of different materials with different dielectric properties). One of the materials must be responsive to microwaves.

It is also a very strong advantage of the present invention that in many embodiments it is a continuous process rather than a batch process. By having a continuous flow of material through a treatment zone, we make the process far more amenable to industrial application. The material to be treated in many embodiments of the invention (whether that be to weaken the bond between two phases or for some other treatment purposes) passes through the cavity and experiences, short duration, microwave pulses that create high power densities. This is in contrast to batch processes where the material is loaded into a cavity with the microwave power "off", and then microwaves are applied, and then the microwaves are turned off, and then the material removed from the cavity.

Thus a microwave treatment zone can be established and a material flowed/moved through it. In principle if the electric field strength of the microwaves vary across the treatment zone streams of material (possibly different material) may be arranged to pass through different parts of the cavity so as to expose the different streams to different electric field strength microwaves. In order to get the most benefit out of any particular microwave generator (e.g. magnetron) one of the streams will go through the maximum field strength region. In systems where there is no substantial variation in field strength across the cavity, or where the field strength is high enough at all places in the cavity, this point is moot.

The process may be semi-continuous (i.e. continuous flow of material through the treatment for periods, and no flow for periods).

A further significant factor is the fact that we have realised that with sufficiently high field strengths to achieve sufficiently high temperature gradients, the material does not have to be exposed to microwaves for very long. Traditionally, the prior art has exposed materials to microwaves for ten seconds or more, sometimes up to many minutes. We believe that it is necessary to expose the material to microwaves, of sufficiently high field strength, for a second or less, and most preferably for less than about half a second, and even more preferably for a time of the order of 0.2 seconds, or perhaps even less. FIG. 15 illustrates that 0.2 seconds is an appropriate time when most of the weakening to the material has been achieved. Similarly, FIG. 14 shows that the difference in stress achieved between heating times of 0.5 seconds and 0.25 seconds is not very great, especially in comparison to the difference between 0.05 seconds and 0.25 seconds. This again points to about one quarter of a second being a suitable time to apply high-power microwaves for maximum result per unit cost.

However, for short duration pulsed microwaves (e.g. of the order of 1 μs for a pulse) we have found that even shorter exposure to pulses is effective. For example exposure to pulses for an aggregate time of the order of 1 ms "hits" an ore with pulses of microwave, with substantial weakening of material.

Making the pre-treatment of two phase material with microwaves an economic proposition is improved by heating the materials with microwaves for a shorter time (much shorter) than the prior art suggests is to be done.

The short exposure time to microwaves can be achieved in the examples of equipment given by flowing the material through the treatment zone at a high rate (i.e. so that it flows through the high intensity maxima regions in about a quarter of a second or perhaps less). It might flow through in something of the order of a second or less in other examples. This has the double benefit of achieving the most heating effect per unit cost in microwave power, and also increasing throughput of material through the heating zone—i.e. treating more material per second than was previously thought possible. This double benefit is very interesting. This also makes microwave pre-treatment even more financially feasible.

The invention is applicable to extracting one phase of material from another phase. For example it can be used to extract a liquid from a solid phase (e.g. extract water from a mineral, e.g. coal or talc).

In one example, we use 15 kW microwave applied for about 0.1 seconds. This gives an idea of what is meant by "high electric field", or "high power density".

It is estimated that the comminution process to recover minerals from ores simply using mechanical treatment of the ores, without microwave treatment, uses about 25 kW hours per ton of ore. It is estimated that using the present invention, this energy consumption could be reduced by half, or possibly even down to 80 or 90% less energy.

Since 60% to 70% of mineral processing plant costs relate to plant energy consumption, this is a very significant reduction in the cost of producing minerals. Furthermore, by weakening the material to be broken up by the comminution plant, there is less wear on the plant, the process is speeded up, and there is a higher throughput through the mechanical comminution process. Moreover, because the materials are intergranually broken, it is easier to recover the desired mineral. The ratio of recovery has been determined to be 3 or 4% better than if no microwave pre-treatment is used.

This experimental result of an increase of a few percent in recovery rate is the first time that this has been observed. We subscribe the achievement of this effect to the higher electric field strength microwaves that are applied.

We may have a resonance time/time for materials to be in the high field strength region of the cavity of the order of 0.1 to 0.01 or even 0.001, seconds, or thereabouts. This is a very high throughput compared to the prior art.

Although gravity-fed systems are what are described in relation to FIGS. 3, 4*a* and 4*b*, it is of course envisaged to have other feed mechanisms, such as pressure fed, conveyor belt fed, fluidised particle fed, centrifugal fed, or hopper fed, etc.

The moisture content of the ore may influence the selected power density.

There may be a control processor controlling the tuning of the microwave cavity, and (in some embodiments) controlling the position of the maxima, or the position of the material in the cavity and controlling, optionally, the relative position of the flow of materials through the cavity and the position of the maxima. There may be a material-sensor providing feedback signals to the control processor, and/or there may be an electric field probe to assist in monitoring the process, again providing feedback signals to the control processor. Software for some embodiments to ensure that the physical position of the materials is lined up with the physical position of the maximum intensity of microwaves is also envisaged.

There may be flow-rate control means, optionally controlled by the processor, capable of varying the volume flow rate of material through the microwave cavity. This may be necessary to ensure that the material experiences the correct microwave conditions.

Particle size may influence the desired volume flow rate and/or power density. There may be a particle size sensor, or a particle size input mechanism (e.g. keyboard), for providing information to the control processor relating to the particle size of the materials being microwaved. The control processor may use this information to vary the linear or volume flow-rate and/or power density.

There may be a controlled atmosphere in the cavity, for example a nitrogen atmosphere or other inert gas atmosphere.

Other uses for the invention include separating two materials in a general sense—for example de-husking nuts (or making it easier to separate two materials).

Moreover, the idea of achieving rapid heating using a very high field strength very quickly applies to things that do not necessarily involve separating materials. For example, drying materials, processing them to cause changes in the nature of the material, food processing.

The concept of creating a standing wave in a microwave cavity and establishing where in the microwave cavity is the maximum electric field strength of the standing wave and ensuring that material to be processed is disposed in the cavity at the position of maximum field strength, can be applied to all sorts of physical processing. For example, rapid heating can cause fluffing of a material, and rapid heating can be useful in chemical processing.

High power density for a short time, is a distinction over the art.

It will be appreciated that the conceptual, schematic, illustrative, waveforms of amplitudes of standing waves shown in the Figures are not binding and are not restrictive. A three dimensional cavity may have a more complex standing wave, typically with only a single maxima where constructive interference creates a maximum/maximised field strength region, and the material to be processed will be disposed there.

The presence of the material in the cavity may possibly in some circumstances influence where the maxima is found, and so the cavity may need to be tuned for use with a specific material of a specific volume/shape, or flow rate, at a specific expected place in the cavity. Since electric field strength varies with a general square relationship with power density, electric field strength can fall off quite rapidly with distance as one moves away from a position of maximum intensity—relatively careful alignment of the position of the material to be processed and the cavity/standing wave may be desirable.

By "microwave" in the claims we mean at a first level microwaves at permitted industrial microwave frequencies (currently 2.45 GHz, 915/896 MHz and 433 MHz), and also microwaves generally (any frequency can be used if a Faraday cage is used to prevent electromagnetic pollution), and also RF heating frequencies, typically 27.12 MHz. We also intend to cover any electromagnetic radiation which heats two materials differentially, i.e. infra red or ultra violet. "Microwave" in the claims can be read as "electromagnetic radiation" (suitable for heating the materials concerned).

It will be appreciated that while the material is present in the microwave treatment zone, it is not necessarily constantly exposed to microwave radiation. The material could have an exposure time to microwave radiation of the order of 5 μs, a few μs, tens of μs, a few tens of μs, or a few, or tens of hundreds of μs which could be one pulse or a series of shorter pulses, which can be significantly less than the residence time in the microwave treatment zone, which could be of the order of seconds or tenths of a second.

It will also be appreciated that a plurality of cavities could be used in series or parallel to achieve the desired throughput of multi-phase material, typically 1000 tonnes per hour. However, most embodiments will have one cavity which is capable of processing 1000 tonnes of multi-phase material per hour.

It will further be appreciated that the temperature gradient created at the boundaries of the separate phases within the multi-phase material will be ten, a few ten or several tens of ° C. but will be created over a very short time in order to create enough thermal stress to break the bonds between the different phases.

A large diamond mine can process 5 million tonnes of multi-phase material in a year as only approximately one part per million of the multi-phase material is diamond. Whereas a copper mine, where the copper is significantly more abundant than the diamond, can process ¼ million tonnes per day.

The microwave cavity used can be of the order of 25 cm wide and 40 cm long. Where a conveyor belt is used to deliver the mineral through the microwave cavity, a typical belt velocity could be of the order of 4 $ms^{-1}$ (perhaps 4 or 5 $ms^{-1}$). This would enable a residence time within the cavity of 0.1 seconds, however, the total microware treatment time may be several micro second pulses within a millisecond, or one microsecond microwave pulse may produce a suitably high enough power density.

We may apply 10-100 MW of microwave energy, but over a very short time (e.g. of the order of a small fraction of a second (e.g. a microsecond or so, or a millisecond or so).

There may be a total temperature rise of the bulk material of not much more than about 50° C.

TABLE 9

| References |
|---|
| Bearman, R. A. Briggs, C. A. and Kojovic, T., 1997. The application of rock mechanics parameters to the prediction of comminution behaviour. Minerals Engineering 10, 3 255-264. |
| Bearman R. A., 1999. The use of the point load test for the rapid estimation of Mode I fracture toughness. International Journal of Rock mechanics and Miming Sciences., 257-263. |
| Bieniawski Z. T., 1975. The Point Load Test in Engineering Practice, Engineering Geology. 9, 1-11. |
| Broch E. and Franklin J. A. (1972) The Point Load Strength Test. International Journal of Rock Mechanics and Mining Sciences., Vol. 9, 669 to 697. |
| Chen TT, Dutrizac JE, Haque KE, Wyslouzil W Kashyap S., 1984. The Relative Transparency of Minerals to Microwave Radiation. Can. Metall. Quart. 23, 1, 349-351. |
| Harrison P. C. 1997. A fundamental study of the heating effect of 2.45 GHz microwave radiation on minerals. Ph.D. Thesis, University of Birmingham. |
| Itasca, 1995. Fast Langrangrian Analysis of Continua, Version 3.3, Itasca Consulting Group Inc., Minneapolis, Minnesota, USA |
| Kingman, S. W. The Effect of Microwave Radiation on the comminution and beneficiation of minerals and ores. Ph.D. Thesis, University of Birmingham. |
| Kingman SW Vorster W Rowson NA 2000. The Influence of Mineralogy on Microwave Assisted Grinding. Minerals Engineering., 13, 3, 313-327. |
| Napier-Munn TJ, Morell, S., Morrison, R. D., Kojovic, T. 1996. Mineral Comminution Circuits. Their Operation and Optimisation. JKMRC Monograph Series in Mining and Mineral Processing 2. JKMRC, Queensland, Australia. |
| Rhodes M. 1998. Introduction to particle Technology, John Wiley and Sons Ltd, Chichester UK. |
| Salsman, J. B. Williamson, R. L. Tolley W. K. and. Rice, D. A 1996. Short pulse microwave treatment of disseminated sulphide ores. Minerals Engineering., 9, 1, 43-54. |
| Veasey TJ and Fitzgibbon KE. 1990. Thermally Assisted Liberation of Minerals - A Review. Minerals Engineering,. 3, 1/2, 181-185. |
| Walkiwicz JW, Kazonich G, McGill SL. 1988. Microwave Heating Characteristics of Selected Minerals and Compounds., Minerals and Metallurgical Processing 5, 1, 39-42. |

The invention claimed is:

1. A method of facilitating the extraction of a mineral extracted from an ore having a plurality of phases of materials comprising causing weakening of inter-phase boundaries by exposing said ore to microwaves for a time of less than 0.1 second, the microwaves having high enough field strengths and being applied for a short enough time to cause differential thermal expansion between materials of different phases to cause weakening between phases whilst avoiding causing significant chemical changes to the ore, or at least to the mineral to be extracted.

2. A method according to claim 1 wherein said ore is exposed to the microwaves for a time of less than 0.01 second.

3. A method according to claim 1 wherein pulses of microwaves are emitted substantially continuously and said pulses have a duration from the group consisting of (i) of the order of 1 μs or less; (ii) of the order of 10 μs or less; (iii) of the order of 100 μs or less; (iv) of the order of 1 ms or less; and (v) of the order of 10 ms or less; of the order of 100 ms or less.

4. A method according to claim 3 wherein said substance, whilst in said treatment area, experiences a series of pulses of energy, said series having a number of pulses selected from the group consisting of: (i) of the order of 100 pulses or more; (ii) of the order of 50 pulses or more; (iii) of the order of 10 pulses or more; (iv) of the order of 5 pulses or more; (v) of the order of 2 pulses or more; and (vi) of the order of one pulse.

5. A method of increasing the yield of a mineral extracted from an ore having a plurality of phases of materials comprising causing weakening of inter-phase boundaries by exposing said ore to high field strength microwaves for a time of less than 0.1 second, the microwaves having high enough field strengths and being applied for a short enough time to cause differential thermal expansion between materials of different phases to cause weakening between phases whilst avoiding causing significant chemical changes to the ore, or at least to the mineral to be extracted, wherein the power density produced by the microwaves in the treatment area is selected from the group consisting of the order of (i) $10^{15}$ $Wm^{-3}$ or more; and (ii) $10^{16}Wm^{-3}$ or more, further wherein pulses of microwaves are emitted substantially continuously and said pulses have a duration from the group consisting of (i) of the order of 1 μs or less; (ii) of the order of 10 μs or less; (iii) of the order of 100 μs or less; (iv) of the order of 1 ms or less; and (v) of the order of 10ms or less; (vi) of the order of 100 ms or less, and further wherein said ore, whilst in said treatment area, experiences a series of pulses of energy, said series having a number of pulses selected from the group consisting of: (i) of the order of 100 pulses or more; (ii) of the order of 50 pulses or more; (iii) of the order of 10 pulses or more; (iv) of the order of 5 pulses or more; (v) of the order of 2 pulses or more; and (vi) of the order of one pulse.

6. A method of microwave treatment of a multi-phase material for facilitating the extraction of one phase of the material from another phase of the material, the method comprising heating said material with microwaves, producing a power density of at least $10^9$ $Wm^{-3}$ in a continuous process in which said material moves into and through a microwave treatment area and experiences exposure to said microwaves in said treatment area for a time of the order of ½ second or less, said time being a short enough time to avoid causing substantial chemical changes to said phase of said multi-phase material that is to be extracted, wherein said material experiences microwaves in said treatment area for a time selected from the group consisting of: (i) of the order of 0.1 second or less; (ii) of the order of 0.01 second or less; and (iii) of the order of 0.001 second or less, wherein said one phase comprises a desired mineral and said another phase comprises a rock substrate surrounding said mineral, and wherein said microwaves significantly weakens the bond strength between said mineral and said surrounding substrate by causing local differential thermal expansion.

7. A method according to claim 6 wherein said microwaves are applied to said material for a short enough time to avoid causing substantial chemical changes to (i) said mineral; and/or (ii) both said material and substrate, that would detrimentally influence the efficiency of subsequent separation of said mineral and substrate.

* * * * *